US009747800B2

(12) United States Patent
Suzuki et al.

(10) Patent No.: US 9,747,800 B2
(45) Date of Patent: Aug. 29, 2017

(54) VEHICLE RECOGNITION NOTIFICATION APPARATUS AND VEHICLE RECOGNITION NOTIFICATION SYSTEM

(71) Applicant: DENSO CORPORATION, Kariya, Aichi-pref. (JP)

(72) Inventors: Takamitsu Suzuki, Kariya (JP); Takahira Katoh, Kariya (JP); Takeshi Yamamoto, Kariya (JP); Yuuko Nakamura, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/126,088

(22) PCT Filed: Mar. 16, 2015

(86) PCT No.: PCT/JP2015/001446

§ 371 (c)(1),
(2) Date: Sep. 14, 2016

(87) PCT Pub. No.: WO2015/146061

PCT Pub. Date: Oct. 1, 2015

(65) Prior Publication Data

US 2017/0076605 A1 Mar. 16, 2017

(30) Foreign Application Priority Data

Mar. 28, 2014 (JP) ..... 2014-070022

(51) Int. Cl.
*G08G 1/00* (2006.01)
*G08G 1/16* (2006.01)
(Continued)

(52) U.S. Cl.
CPC ..... *G08G 1/163* (2013.01); *G08G 1/09* (2013.01); *G08G 1/133* (2013.01); *G08G 1/16* (2013.01)

(58) Field of Classification Search
None
See application file for complete search history.

(56) References Cited

U.S. PATENT DOCUMENTS

2003/0225511 A1 12/2003 Kushida et al.
2014/0231166 A1* 8/2014 Miller ..... B60W 40/08 180/272

FOREIGN PATENT DOCUMENTS

JP 3773040 B2 5/2006
JP 2007249757 A 9/2007
(Continued)

*Primary Examiner* — Brian Zimmerman
*Assistant Examiner* — Kevin Lau
(74) *Attorney, Agent, or Firm* — Harness, Dickey & Pierce, P.L.C.

(57) ABSTRACT

A vehicle recognition notification apparatus mounted on a subject vehicle includes: a recognition information reception processing section; an another-driver recognition state determination section; an informing control section; a subject-driver recognition state determination section; a recognition information transmission processing section; a subject-vehicle position acquisition section; a vehicle information reception processing section; an another-vehicle position acquisition section; and a visual line detection section. The subject-driver recognition state determination section determines whether the driver of the subject vehicle recognizes the other vehicle. The another-driver recognition state determination section determines whether the subject vehicle is present in a predetermined viewable range of the other vehicle.

8 Claims, 8 Drawing Sheets

(51) Int. Cl.
*G08G 1/09* (2006.01)
*G08G 1/133* (2006.01)

(56) References Cited

FOREIGN PATENT DOCUMENTS

| | | | |
|---|---|---|---|
| JP | 2008210051 | A | 9/2008 |
| JP | 2009134704 | A | 6/2009 |
| JP | 2010238053 | A | 10/2010 |

* cited by examiner

<SURROUNDING VEHICLE LIST>

| VEHICLE ID | OTHER VEHICLE RECEPTION DATA | TARGET VEHICLE FLAG |
|---|---|---|
| 101 | DATA(ID=101) | 1 |
| 102 | DATA(ID=102) | 1 |
| 103 | DATA(ID=103) | 0 |

VEHICLE DATA OF VEHICLE ID = 101

| TIME RECEIVED | VEHICLE POSITION | TRAVEL DIRECTION | VEHICLE SPEED | ACCELERATION |
|---|---|---|---|---|
| T3 | (X3, Y3) | θ3 | V3 | A3 |
| T2 | (X2, Y2) | θ2 | V2 | A2 |
| T1 | (X1, Y1) | θ1 | V1 | A1 |

VEHICLE RECOGNITION NOTIFICATION APPARATUS AND VEHICLE RECOGNITION NOTIFICATION SYSTEM

CROSS REFERENCE TO RELATED APPLICATIONS

This application is a U.S. National Phase Application under 35 U.S.C. 371 of International Application No. PCT/JP2015/001446 filed on Mar. 16, 2015 and published in Japanese as WO 2015/146061 A1 on Oct. 1, 2015. This application is based on and claims the benefit of priority from Japanese Patent Application No. 2014-070022 filed on Mar. 28, 2014. The entire disclosures of all of the above applications are incorporated herein by reference.

TECHNICAL FIELD

The present disclosure relates to a vehicle recognition notification apparatus and a vehicle recognition notification system.

BACKGROUND ART

Conventionally, there is a technique where vehicles establish wireless communications (so-called vehicle-to-vehicle communications) with each other to share positional information of a vehicle present within a range of the wireless communications. For example, Patent Literature 1 discloses a vehicular recognition support system for displaying, on a display device, a symbol indicating the presence of another vehicle sharing positional information with a subject vehicle and an image of a map indicating a current position of the other vehicle. According to this vehicular recognition support system, it is possible to support a driver of the subject vehicle to recognize the presence of the other vehicle.

When the other vehicle mounted with the vehicular recognition support system disclosed in Patent Literature 1 shares positional information with the subject vehicle, the display device of the other vehicle displays a symbol indicating the presence of the other vehicle and an image of a map indicating a current position of the subject vehicle. Thus, according to the vehicular recognition support system disclosed in Patent Literature 1, it is possible to support a driver of the other vehicle to recognize the presence of the subject vehicle.

The inventors of the present application have found the following fact. According to the vehicular recognition support system disclosed in Patent Literature 1, it is possible to support the driver of the other vehicle to recognize the presence of the subject vehicle; however, it may be unclear for the driver of the subject vehicle as to whether the driver of the other vehicle recognizes the subject vehicle.

PRIOR ART LITERATURE

Patent Literature

Patent Literature 1: JP 3773040 B2

SUMMARY OF INVENTION

It is an object of the present disclosure to provide a vehicle recognition notification apparatus and a vehicle recognition notification system each enabling a driver of a subject vehicle to perceive that a driver of another vehicle recognizes the subject vehicle.

A vehicle recognition apparatus according to one aspect of the present disclosure includes: a recognition information reception processing section that receives a signal transmitted from another vehicle and indicating that a driver of the other vehicle recognizes the subject vehicle; and an informing control section that informs a driver of the subject vehicle that the driver of the other vehicle recognizes the subject vehicle when the recognition information reception processing section receives the signal.

According to the recognition information reception processing section of the disclosure, when the signal indicating that the driver of the other vehicle recognizes the subject vehicle is received from the other vehicle, the informing control section informs the driver of the subject vehicle that the driver of the other vehicle recognizes the subject vehicle. That is, according to the above configuration, the driver of the subject vehicle can perceive that the driver of the other vehicle recognizes the subject vehicle.

A vehicle recognition notification system according to another aspect of the present disclosure includes: a first vehicle recognition notification apparatus mounted on a first vehicle; and a second vehicle recognition notification apparatus mounted on a second vehicle. The first vehicle recognition notification apparatus includes a subject-driver recognition state determination section that determines whether a driver of the first vehicle recognizes the second vehicle, and a recognition information transmission processing section that transmits to the second vehicle a signal indicating that the driver of the first vehicle recognizes the second vehicle when the subject-driver recognition state determination section determines that the driver of the first vehicle recognizes the second vehicle. The second vehicle recognition notification apparatus includes a recognition information reception processing section that receives the signal transmitted from the first vehicle, and an informing control section that informs a driver of the second vehicle that the driver of the first vehicle recognizes the second vehicle when the recognition information reception processing section receives the signal.

According to the vehicle recognition notification system of the disclosure, when the signal indicating that the driver of the other vehicle recognizes the subject vehicle is received from the other vehicle, the informing control section informs the driver of the subject vehicle that the driver of the other vehicle recognizes the subject vehicle. That is, according to the above configuration, the driver of the subject vehicle can perceive that the driver of the other vehicle recognizes the subject vehicle.

BRIEF DESCRIPTION OF DRAWINGS

The above and other aspects, features and advantages of the present disclosure will become more apparent from the following detailed description made with reference to the accompanying drawings. In the drawings.

PREFERRED EMBODIMENTS FOR CARRYING OUT INVENTION

Figure 1:
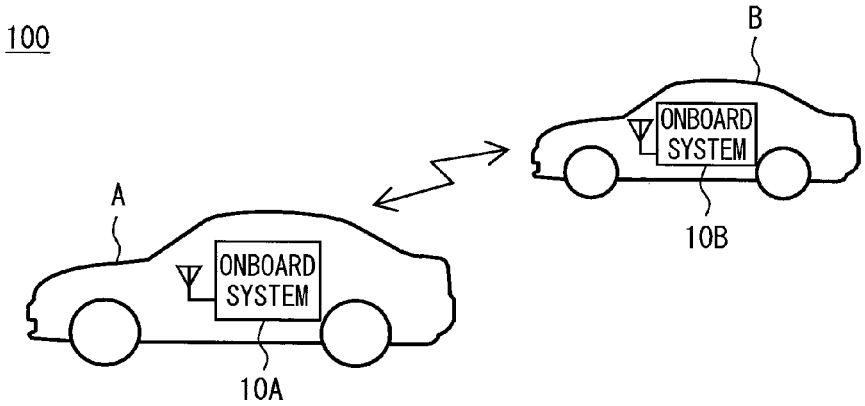
FIG. 1 is a diagram showing an example of a schematic configuration of a vehicle recognition notification system according to the embodiment.

Hereinafter, an embodiment of the disclosure is described with reference to the drawings. FIG. 1 is a view showing an example of a schematic configuration of a vehicle recognition notification system 100 according to the embodiment. The vehicle recognition notification system 100 includes vehicle onboard systems 10A and 10B mounted in vehicles A and B, respectively as shown in FIG. 1. The vehicle onboard systems 10A and 10B mounted in the respective vehicles have similar functions and hereinafter are each referred to as a vehicle onboard system 10 unless these systems are distinguished from each other.

Hereinafter, any one vehicle mounted with the vehicle onboard system 10 is referred to as a subject vehicle. In multiple vehicles mounted with the vehicle onboard systems 10, a relationship between a subject vehicle and another vehicle is determined in a relative manner. It is assumed in FIG. 1 that the vehicle A is a subject vehicle whereas the vehicle B is another vehicle. As an example, the vehicle A corresponds to a first vehicle of the disclosure, and the vehicle B corresponds to a second vehicle of the disclosure. Hereinafter, a configuration of the vehicle onboard system 10 is described in detail.

Figure 2:
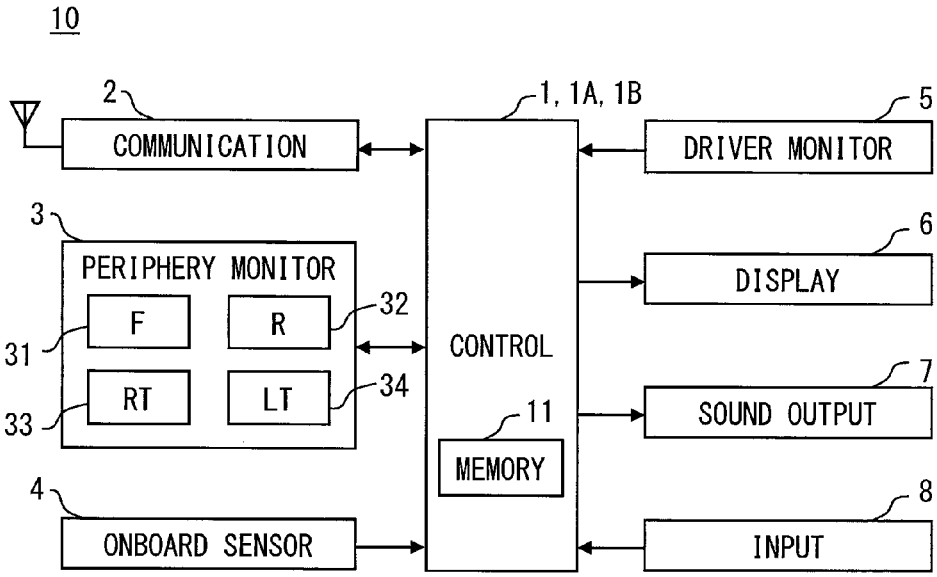
FIG. 2 is a block diagram showing an example of a schematic configuration of a vehicle onboard system in the embodiment.

As shown in FIG. 2, the vehicle onboard system 10 includes a controller 1 (also referred to as a successive controller), a communication device 2, a periphery monitoring system 3, a vehicle onboard sensor group 4, a driver monitor 5, a display device 6, a sound output device 7, and an input device 8. The controller 1, the communication device 2, the periphery monitoring system 3, the vehicle onboard sensor group 4, the driver monitor 5, the display device 6, the sound output device 7, and the input device 8 establish mutual communications with one another through a known intra-vehicle communication network. The intra-vehicle communication network may be constructed by wire communication or may be constructed by wireless communication. The intra-vehicle communication network may be constructed by a combination of wire communication and wireless communication.

The communication device 2 includes a transmitting and receiving antenna. The communication device 2 of the subject vehicle transmits and receives information to and from the communication device 2 of another vehicle present on the periphery of the subject vehicle by broadcast wireless communication without involving a communication network. That is, the communication device 2 establishes vehicle-to-vehicle communication.

The vehicle-to-vehicle communication uses electric waves in a 700 MHz band, for example, and a wirelessly communicable range for the communication device 2 is set to be within several hundred meters with the subject vehicle at the center. That is, the subject vehicle successively establishes vehicle-to-vehicle communications with the other vehicle present in the wirelessly communicable range. A frequency band for use in the vehicle-to-vehicle communication may be a frequency band other than the 700 MHz band, and for example, a 5.8 GHz band, a 2.4 GHz band, or the like may be used. The wirelessly communicable range may be designed as appropriate. A communication destination in the vehicle-to-vehicle communication can be specified by use of a vehicle ID included in the information to be transmitted or received. The vehicle ID is an identification code that is set for each vehicle in order to identify vehicles.

The periphery monitoring system 3 is mounted in the subject vehicle. Based on a command from a periphery monitoring control section F2 of the controller 1, the periphery monitoring system 3 detects an obstacle (that is, another vehicle) on the periphery of the subject vehicle and outputs, to the controller 1, data indicating a relative position, a relative speed or the like of the detected vehicle. A result of the detection by the periphery monitoring system 3 is used complementarily to vehicle information (to be detailed in detail later) received in the vehicle-to-vehicle communication so as to more accurately acquire information (for example, positional information, vehicle speed) concerning the other vehicle present on the periphery of the subject vehicle.

In the embodiment, the periphery monitoring system 3 includes a front monitoring unit 31, a rear monitoring unit 32, a right-side monitoring unit 33, and a left-side monitoring unit 34.

Each unit is briefly described as follows. The front monitoring unit 31 successively detects an obstacle in front of the subject vehicle. The rear monitoring unit 32 successively detects an obstacle behind the subject vehicle. The right-side monitoring unit 33 successively detects an obstacle on the right side of the subject vehicle. The left-side monitoring unit 34 successively detects an obstacle on the left side of the subject vehicle. Next, details of the configuration and operation of each unit are described.

The front monitoring unit 31 includes, for example, a front-view camera (not shown) that captures an image in front of the subject vehicle, and a front obstacle sensor (not shown) that detects an obstacle (the other vehicle, here) in front of the subject vehicle by using reflected waves obtained by reflection of electromagnetic waves or sound waves. The term "front" here indicates a range including diagonally front left and diagonally front right in addition to a front direction of the subject vehicle.

The front-view camera is, for example, an optical camera, and a CMOS camera, a CCD camera, or the like can be used, for example. In addition to the above cameras, an infrared camera may be used as the front-view camera. The front-view camera may be installed near a rearview mirror in the vehicle, for example, so as to photograph a predetermined range in front of the subject vehicle.

The front obstacle sensor is a known obstacle sensor that detects a distance to the obstacle, a direction in which the obstacle is present, and a relative speed of the obstacle, based on a change in phase and a difference between a time of transmission of exploration waves and a time of reception of reflected waves generated by reflection of the exploration waves from the object. A millimeter-wave radar is employed here as an example. The front obstacle sensor may be installed near the center of a front bumper, for example, so as to transmit exploration waves to the predetermined range in front of the subject vehicle.

In addition to the above sensors, the front obstacle sensor may be a laser radar, an infrared sensor, or an ultrasonic sensor. The front obstacle sensor may be a distance measurement system for specifying a position from parallax of images photographed by multiple cameras, or the like.

Upon detection of the other vehicle from an image taken by the front-view camera, or data of detection by the front obstacle sensor, the front monitoring unit 31 provides the other vehicle with a detection vehicle ID, which is unique to each of the other vehicles, and calculates a relative position, a relative speed or the like of the other vehicle with respect to the subject vehicle.

For example, upon detection of the other vehicle present in front of the subject vehicle through image recognition or the like using image information of the front-view camera, the front monitoring unit 31 detects a distance to the other vehicle, and a direction in which the other vehicle is present, with the front obstacle sensor. The front monitoring unit 31 then specifies the distance and the direction to calculate the relative position of the other vehicle with respect to the subject vehicle. For determining whether the detected object is a vehicle, a known pattern matching technique or the like may be applied.

The front monitoring unit 31 tracks the other vehicle once detected and provided with the detection vehicle ID, using a known object tracking method, thereby keeping the identical other vehicle in the state of being provided with the identical detection vehicle ID so long as executing the tracking.

The front monitoring unit 31 then creates data (front vehicle data), where the detection vehicle ID allocated to the other vehicle is associated with the relative position and the relative speed of the other vehicle, and outputs the data to the successive controller 1.

In addition, as another mode, the front monitoring unit 31 may detect a distance to the other vehicle by use of only the front obstacle sensor, without the front-view camera. The front monitoring unit 31 may detect the other vehicle by use of only an image photographed by the front-view camera, without the front obstacle sensor.

The rear monitoring unit 32 includes a rear-view camera (not shown) that captures an image behind the subject vehicle, and a rear obstacle sensor (not shown) that detects an obstacle (that is, the other vehicle) behind the subject vehicle by using reflected waves obtained by reflection of exploration waves such as electromagnetic waves. The term "rear" here indicates a range including diagonally rear left and diagonally rear right in addition to a rear direction of the subject vehicle.

The rear-view camera and the rear obstacle sensor have similar configurations to those of the front-view camera and the front obstacle sensor except for differences in installed place and photographing range (or detection range). That is, the rear-view camera may be an optical camera installed at the top of a rear window, for example, so as to photograph a predetermined range behind the subject vehicle. The rear obstacle sensor is a millimeter-wave radar installed so as to form a detection range in a predetermined range behind the subject vehicle. The rear obstacle sensor may be installed near the center of a rear bumper, for example, so as to transmit exploration waves to the predetermined range behind the subject vehicle.

Upon detection of the other vehicle present behind the subject vehicle from an image photographed by the rear-view camera, or data of detection by the rear obstacle sensor, the rear monitoring unit 32 also calculates a relative position, a relative speed or the like of the other vehicle with respect to the subject vehicle for each of the other vehicles. Similarly to the front monitoring unit 31, the rear monitoring unit 32 manages the information for each of the other vehicles by use of the detection vehicle ID allocated to each of the other vehicles.

The rear monitoring unit 32 then creates data (rear vehicle data), where the detection vehicle ID allocated to the other vehicle is associated with the relative position and relative speed of the other vehicle, and outputs the data to the successive controller 1.

The right-side monitoring unit 33 includes a right-side obstacle sensor that detects a distance to the other vehicle present on the right side of the subject vehicle, and a direction in which the other vehicle is present, by using the time from transmission of exploration waves to reception of reflected waves of the exploration waves. A variety of obstacle sensors can be employed for the right-side obstacle sensor, and in the embodiment, as an example, a millimeter-wave radar is employed similarly to the front obstacle sensor, the rear obstacle sensor or the like. The term "right-side" here includes a range from diagonally front right to diagonally rear right of the subject vehicle.

Information of the other vehicle detected by the right-side obstacle sensor is supplied to the controller 1. More specifically, upon detection of the other vehicle, the right-side monitoring unit 33 calculates a relative position, a relative speed or the like of the other vehicle with respect to the subject vehicle for each of the other vehicles. Similarly to the front monitoring unit 31, the right-side monitoring unit 33 manages the information for each of the other vehicles by use of the detection vehicle ID allocated to each of the other vehicles. The right-side monitoring unit 33 then creates data (right-side vehicle data), where the detection vehicle ID allocated to the other vehicle is associated with the relative position and relative speed of the other vehicle, and outputs the data to the successive controller 1.

The left-side monitoring unit 34 includes a left-side obstacle sensor that detects a distance to the other vehicle present on the left side of the subject vehicle, and a direction in which the other vehicle is present, by using the time from transmission of exploration waves to reception of reflected waves of the exploration waves. A variety of obstacle sensors can be employed for the left-side obstacle sensor, and in the embodiment, as an example, a millimeter-wave radar is employed similarly to the other obstacle sensors or the like. The term "left-side" here includes a range from diagonally front left to diagonally rear left of the subject vehicle.

The information of the obstacle detected by the left-side obstacle sensor is supplied to the controller 1. More specifically, upon detection of the other vehicle, the left-side monitoring unit 34 calculates a relative position, a relative speed or the like of the other vehicle with respect to the subject vehicle for each of the other vehicles. Similarly to the front monitoring unit 31, the left-side monitoring unit 34 manages the information for each of the other vehicles by use of the detection vehicle ID allocated to each of the other vehicles. The left-side monitoring unit 34 then creates data (left-side vehicle data), where the detection vehicle ID allocated to the other vehicle is associated with the relative position and relative speed of the other vehicle, and outputs the data to the successive controller 1.

In the embodiment, the right-side monitoring unit 33 and the left-side monitoring unit 34 include no camera, differently from the front monitoring unit 31 and the rear monitoring unit 32. However, the disclosure is not limited to this configuration. That is, the right-side monitoring unit 33 and the left-side monitoring unit 34 may include a camera, similarly to the front monitoring unit 31 and the rear monitoring unit 32.

When an omnidirectional laser radar or the like can be used as the obstacle sensor, obstacles in front of, behind, on the right side, and the left side of the subject vehicle may be detected by the omnidirectional obstacle laser radar.

The vehicle onboard sensor group 4 is a variety of sensors which are mounted on the subject vehicle to detect a state of the subject vehicle. The vehicle onboard sensor group 4 includes, for example, a vehicle speed sensor, an acceleration sensor, a gyro sensor, a GNSS receiver, a steering angle sensor, a brake stroke sensor, an accelerator pedal sensor, a turning indication lever position sensor, a door mirror angle sensor or the like.

The vehicle speed sensor detects a traveling speed of the subject vehicle, and the acceleration sensor detects acceleration acting on the subject vehicle. The GNSS receiver receives electric waves from a satellite used in a global navigation satellite system (GNSS) to acquire data indicating a current position of the GNSS receiver. For example, a GPS receiver can be used as the GNSS receiver.

The gyro sensor detects a rotational angular speed around a vertical axis of the subject vehicle, and the steering angle sensor detects a steering angle based on a turning angle of a steering. The brake stroke sensor detects a quantity of stepping on a brake pedal, and the accelerator pedal sensor detects a quantity of stepping on an accelerator pedal. The turning indication lever position sensor detects whether a turning indication lever is at a turn-left position or a turn-right position.

The door mirror angle sensor is a sensor that detects an angle of a mirror surface of each of right and left door mirrors provided in the subject vehicle. A detection value obtained by the detection of each of the variety of sensors included in the vehicle onboard sensor group 4 is outputted to the successive controller 1.

The driver monitor 5 is installed inside the vehicle in such a posture as to turn a photographing surface to the driver. The driver monitor 5 photographs a range including the face of the driver successively (for example, every 100 milliseconds) and outputs image data of the photographed image to the controller 1 successively. In the embodiment, the driver monitor 5 is fitted onto a steering column cover, but may be fitted to a rear-view mirror portion or the like as another mode.

In the embodiment, an infrared camera is used as the driver monitor 5 to capture an image even in an environment with little visible light by detecting infrared rays. In addition to the infrared camera, the driver monitor 5 may be an optical camera or the like which senses visible light, such as a CMOS camera or a CCD camera. The driver monitor 5 corresponds to a face part photographing device of the disclosure.

The display device 6 displays a text and an image based on an instruction from the controller 1 and informs the driver of a variety of pieces of information. The display device 6 is capable of making full color display, for example, and can be configured with a liquid crystal display, an organic EL display, a plasma display, or the like. In the embodiment, the display device 6 is a center display disposed near the center of an instrument panel in a vehicle width direction.

As another mode, the display device 6 may be a meter display disposed in an upper part of the instrument panel on the driver's seat side. The display device 6 may be a known head-up display that projects a virtual image in a part of a windshield in front of the driver's seat to display a variety of pieces of information. The display device 6 may be realized in combination of the center display, the meter display, the head-up display or the like. When the display device 6 includes multiple displays, the controller 1 may select a display for each data to be displayed, as an output destination of the data.

The sound output device 7 includes a speaker or the like, converts sound data inputted from the controller 1 to a sound (including a simple sound), and outputs the converted sound.

The input device 8 is a mechanical switch (so-called steering switch) provided on a steering wheel. For example, the steering switch as the input device 8 includes multiple switches, and a function according to the driver's preference is allocated to each of the switches. By operating the input device 8, the driver can instruct execution of the function in accordance with the operation. Upon detection of input operation by the driver, the input device 8 outputs to the controller 1 a control signal indicating the input operation.

In the embodiment, the steering switch is employed as the input device 8. The disclosure is not limited to this configuration. The input device 8 may be a sound input device that is achieved by using a known sound recognition technique, or may be a mechanical switch provided on the instrument panel. The input device 8 may be a known touch panel or the like integrally formed with the display device 6.

The controller 1 is configured as a normal computer and includes a CPU, nonvolatile memories (not shown) such as a ROM, an EEPROM, and a flash memory, a volatile memory (not shown) such as a RAM, an I/O (not shown), and a bus line (not shown) for connecting these constituents.

The memory 11 in the controller 1 is a rewritable storing medium achieved by the flash memory or the RAM in the controller 1, for example.

The memory 11 stores a program module and data for executing a variety of processing. The memory 11 stores a vehicle ID set to the subject vehicle, and a surrounding vehicle list.

Figure 3A:
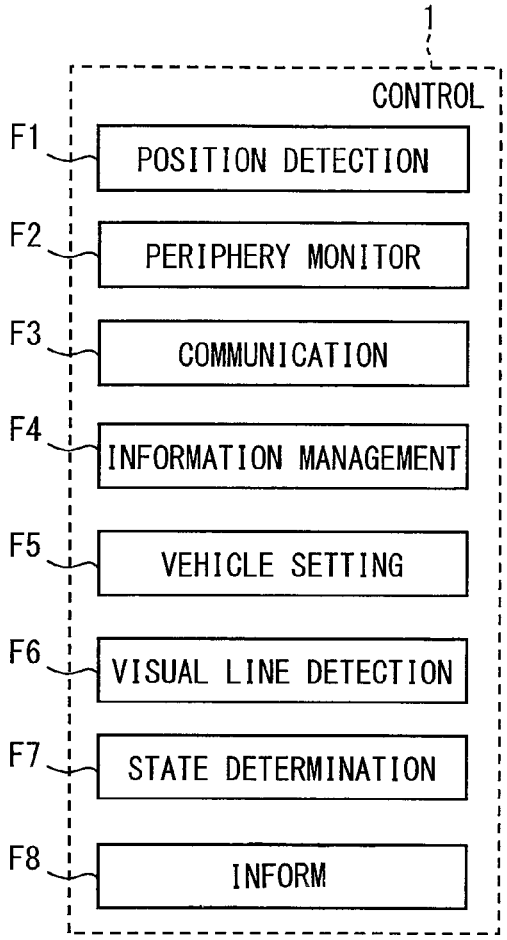
FIG. 3A is a block diagram showing an example of a schematic configuration of a controller according to the embodiment.
Figure 3B:
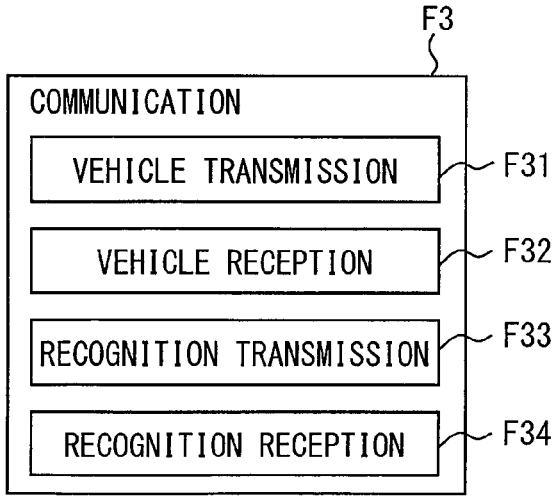
FIG. 3B is a block diagram showing an example of a schematic configuration of a communication processing section according to the embodiment.
Figure 3C:
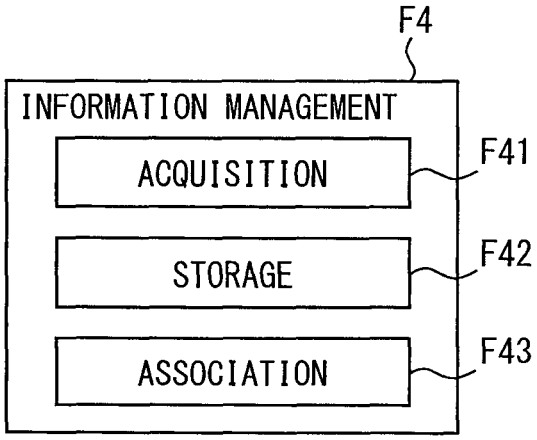
FIG. 3C is a block diagram showing an example of a schematic configuration of a vehicle information management section according to the embodiment.
Figure 3D:
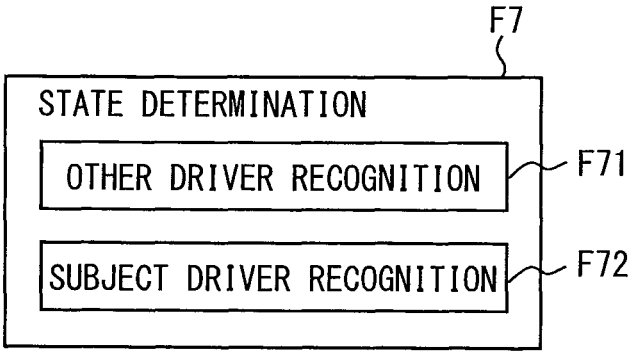
FIG. 3D is a block diagram showing an example of a schematic configuration of a recognition state determination section according to the embodiment.

With reference to FIG. 3A, a function that is achieved by the controller 1 executing a variety of program modules stored in the memory 11 will be explained. As shown in FIG. 3A, the controller 1 includes, as functional blocks, a subject-vehicle position detection section F1, a periphery monitoring control section F2, a communication processing section F3, a vehicle information management section F4, a target-vehicle setting section F5, a visual line detection section F6, a recognition determination section F7, and an informing control section F8. The controller 1 corresponds to a vehicle recognition notification apparatus of the disclosure. The controller 1A in the vehicle onboard system 10A corresponds to a first vehicle recognition notification apparatus of the disclosure, and the controller 1B in the vehicle onboard system 10B corresponds to a second vehicle recognition notification apparatus of the disclosure.

The subject-vehicle position detection section F1 detects a current position of the subject vehicle based on a signal inputted from a sensor in the vehicle onboard sensor group 4 such as the GNSS receiver, the vehicle speed sensor, or the gyro scope. The positional information indicating the current position may be configured to be represented by use of longitude and latitude, for example. The subject-vehicle position detection section F1 acquires positional information successively (for example, every 100 milliseconds).

In addition, since each sensor in the sensor group for detecting the current position has an error with a different characteristic, the sensor group is used such that multiple sensors complement each other. An output value of a part of the sensors may be used depending on the accuracy of each sensor. The subject-vehicle position detection section F1 corresponds to a subject-vehicle position acquisition section of the disclosure.

The periphery monitoring control section F2 controls the operation of the periphery monitoring system 3 and acquires, from the periphery monitoring system 3, information of another vehicle present on the periphery of the subject vehicle. That is, the periphery monitoring control section F2 acquires the front vehicle data from the front monitoring unit 31, the rear vehicle data from the rear monitoring unit 32, the right-side vehicle data from the right-side monitoring unit 33, and the left-side vehicle data from the left-side monitoring unit 34. Based on the data of the other vehicles present in the respective directions, the periphery monitoring control section F2 creates data (referred to as surrounding vehicle data) indicating a relative position and a relative speed for each of the other vehicles present in a range detectable by the periphery monitoring system 3.

In the embodiment, the processing of specifying a relative position or the like of the other vehicle present in each of the directions, such as the front and rear directions, is performed by the monitoring unit corresponding to each of the directions, and the periphery monitoring control section F2 puts together results specified by the respective monitoring units. The disclosure is not limited to this configuration. A part or all of the processing of specifying the relative position or the like of the other vehicle present in each of the directions may be performed by the periphery monitoring control section F2. That is, the periphery monitoring control section F2 may successively acquire data detected by equipment (the camera, the obstacle sensor) in each monitoring unit to specify the relative position, the relative speed or the like of the surrounding vehicle from the data.

The communication processing section F3 controls the operation of the communication device 2 and performs processing of receiving data from the other vehicles present on the periphery of the subject vehicle, and performs processing of transmitting data to all or a part of the other vehicles. As shown in FIGS. 3A to 3D, as more detailed functional blocks, the communication processing section F3 includes a vehicle information transmission processing section F31, a vehicle information reception processing section F32, a recognition information transmission processing section F33, and a recognition information reception processing section F34.

The vehicle information transmission processing section F31 creates vehicle information including at least the vehicle ID and positional information of the subject vehicle, and transmits the information to all of the other vehicles present on the periphery of the subject vehicle via the communication device 2. The vehicle information may be created in accordance with a standard format and may include, in addition to a vehicle ID and positional information, a traveling direction and a vehicle speed of a vehicle to be a transmission source of the vehicle information. In the embodiment, the vehicle information includes the vehicle ID, the positional information, traveling direction, vehicle speed, and acceleration of the transmission source.

As the positional information of the transmission source, the vehicle information may include not only the latest positional information but also time-series data of the positional information where pieces of the positional information of the vehicle are arranged in a time-series manner. The time-series data of the positional information indicates a traveling track of the vehicle. The vehicle information may include information for specifying the position instead of the positional information. The information for specifying the position is, for example, information indicating a vehicle ID of each of other vehicles traveling on the periphery of the transmission source vehicle, and a relative position of each of other vehicles with respect to the vehicle.

The vehicle information reception processing section F32 performs processing of receiving the vehicle information transmitted by the other vehicle. The vehicle information received from the other vehicle is successively outputted to the vehicle information management section F4. The vehicle information transmitted by the other vehicle is created in accordance with a similar data format to that for the vehicle information transmitted by the subject vehicle. That is, the vehicle information reception processing section F32 receives from the other vehicle the vehicle information including the vehicle ID, positional information, traveling direction, vehicle speed, and acceleration of the other vehicle.

The recognition information transmission processing section F33 creates a recognition information signal and transmits the recognition information signal to a predetermined another vehicle. The recognition information signal is a signal indicating whether the driver of the subject vehicle recognizes the presence of the other vehicle.

For example, the recognition information signal includes a vehicle ID of a transmission source, a vehicle ID of another vehicle that is a transmission destination, and recognition information indicating whether the driver of the subject vehicle recognizes the presence of the other vehicle that is the transmission destination. The recognition information may be represented, for example, by a recognition flag that is a flag in the processing. More specifically, when the driver of the subject vehicle recognizes the presence of the other vehicle, a recognition information signal with 1 set to the recognition flag may be transmitted. When the driver of the subject vehicle does not recognize the presence of the other vehicle, a recognition information signal with 0 set to the recognition flag may be transmitted.

The recognition information reception processing section F34 performs processing of receiving the recognition information signal transmitted by the other vehicle to the subject vehicle. That is, the recognition information signal received from the other vehicle indicates whether the driver of the transmission source of the recognition information signal recognizes the subject vehicle or the like. Hereinafter, the driver of the subject vehicle is also referred to as a subject driver, and the driver of the other vehicle is referred to as another driver.

In the embodiment, since each vehicle performs broadcast communication by use of the communication device 2, the communication device 2 of the subject vehicle also receives a recognition information signal transmitted to a vehicle other than the subject vehicle. Accordingly, upon reception of a recognition information signal from the communication device 2, the recognition information reception processing section F34 checks a vehicle ID of a transmission destination included in the recognition information signal with the vehicle ID of the subject vehicle. As a result of the check, the recognition information reception processing section F34 discards the recognition information signal having the vehicle ID of the transmission destination which is not the vehicle ID of the subject vehicle. On the other hand, when the vehicle ID of the transmission destination is the vehicle ID of the subject vehicle, the recognition information reception processing section F34 passes the recognition information signal to the recognition determination section F7. With this configuration, communications with a specific vehicle are established also in the embodiment.

The vehicle information management section F4 manages information of the other vehicles present on the periphery of the subject vehicle. As more detailed functional blocks serving to perform the above roles, the vehicle information management section F4 includes an another-vehicle information acquisition section F41, a vehicle information storage processing section F42, and a surrounding-vehicle association section F43.

The another-vehicle information acquisition section F41 acquires the vehicle information received by the vehicle information reception processing section F32 from the other vehicle, and acquires the surrounding vehicle data from the periphery monitoring control section F2. That is, the another-vehicle information acquisition section F41 acquires information (positional information, a vehicle speed or the like) of each of the other vehicles present on the periphery of the subject vehicle. The another-vehicle information acquisition section F41 corresponds to an another-vehicle position acquisition section of the disclosure.

Figures 4, 5:
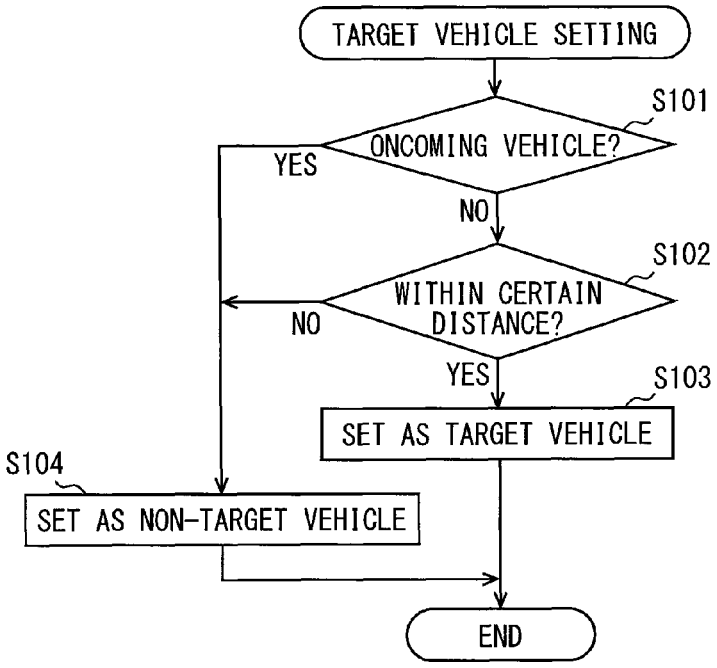
FIG. 4 is a diagram explaining an example of a data structure of a surrounding vehicle list stored in a memory.
FIG. 5 is a flowchart showing an example of target vehicle setting processing that is performed by the controller.

The vehicle information storage processing section F42 stores into the memory 11 the vehicle information of the other vehicle acquired by the another-vehicle information acquisition section F41 from the vehicle information reception processing section F32 while associating the vehicle information with the vehicle ID of the other vehicle as the transmission source. As an example, as shown in FIG. 4, the vehicle information storage processing section F42 of the embodiment manages the vehicle information of the other vehicles present on the periphery of the subject vehicle by use of a surrounding vehicle list including the other vehicles receiving the vehicle information. The surrounding vehicle list includes another-vehicle reception data obtained by listing the vehicle information received from the other vehicle, and a target vehicle setting flag, for each vehicle ID.

The another-vehicle reception data is data obtained by arranging pieces of the vehicle information received from the other vehicles in descending order by reception time. The another-vehicle reception data has a vehicle position, a traveling direction, a vehicle speed, and a transmission interval, which are included in the vehicle information received at each time. The data included in the another-vehicle reception data may be discarded sequentially in ascending order by time. The data of the vehicle ID which does not receive the vehicle information for a particular period of time is deleted from the surrounding vehicle list. The target-vehicle setting flag is described later.

In a similar manner to store the another-vehicle reception data, the vehicle information storage processing section F42 stores into the memory 11 the vehicle information of the subject vehicle created by the vehicle information transmission processing section F31, while arranging pieces of the vehicle information in descending order by creation time. The data including pieces of the vehicle information of the subject vehicle arranged in a time-series manner and stored in the memory 11 is referred to as subject-vehicle data.

The vehicle information storage processing section F42 stores into the memory 11 the data of each of the other vehicles included in the surrounding vehicle data acquired by the another-vehicle information acquisition section F41 from the periphery monitoring control section F2, while distinguishing the data for each detection vehicle ID associated with the data. Hereinafter, the data for each detection vehicle ID is referred to as another-vehicle detection data. The another-vehicle detection data is data obtained by arranging results of detection by the periphery monitoring system 3, such as the relative position and relative speed of the other vehicle with respect to the subject vehicle, in descending order by detection time. For the sake of convenience, the relative position and relative speed of the other vehicle with respect to the subject vehicle, detected by the periphery monitoring system 3, are referred to as a detected relative position and a detected relative speed, respectively.

Based on the another-vehicle detection data for each detection vehicle ID and the another-vehicle detection data for each vehicle ID included in the surrounding vehicle list, the surrounding-vehicle association section F43 associates the other vehicle (that is, detection vehicle ID) detected by the periphery monitoring system 3 with the vehicle ID.

For example, from positional information included in the another-vehicle reception data of a certain vehicle ID and the positional information of the subject vehicle, the surrounding-vehicle association section F43 calculates a relative position of the other vehicle with respect to the subject vehicle (referred to as a received relative position). The surrounding-vehicle association section F43 then compares the foregoing received relative position with the detected relative position of the other vehicle for each of the other vehicles. Of the other vehicles detected by the periphery monitoring system 3, the surrounding-vehicle association section F43 extracts the other vehicle corresponding to the other vehicle transmitting the vehicle information.

More specifically, of the other vehicles detected by the periphery monitoring system 3, the surrounding-vehicle association section F43 determines the other vehicle with a detection vehicle ID, where a difference between the detected relative position of the other vehicle and the received relative position is within a predetermined allowable distance (for example, within 1 meter), as a transmission source of the vehicle information used for calculation of the received relative position. The surrounding-vehicle association section F43 then associates the detection vehicle ID of the other vehicle determined as a transmission source with the vehicle ID of the other vehicle transmitting the vehicle information used for calculation of the received relative position.

In the embodiment, the other vehicle receiving the vehicle information is associated with the other vehicle detected by the periphery monitoring system 3, based on the received relative position and the detected relative position at the current time. However, the invention is not limited to this configuration. Based on the time-series data of the received relative position at multiple time points and the time-series data of the detected relative position at the same plurality of time points, the other vehicles receiving the vehicle information may be associated with the other vehicle detected by the periphery monitoring system 3. The time-series data of the received relative position at the multiple time points may be created based on the another-vehicle reception data stored in the memory 11.

By using the relative speed, the traveling direction, the acceleration, or the like in addition to the relative position, the other vehicle receiving the vehicle information may be associated with the other vehicle detected by the periphery monitoring system 3.

In the case of using the relative speed, a relative speed (referred to as a received relative speed), calculated from the vehicle speed included in the vehicle information received from the other vehicle and the vehicle speed of the subject vehicle acquired from the vehicle onboard sensor group 4, is compared with the detected relative speed stored for each detection vehicle ID to calculate a difference between the detected relative speeds. Then, the other vehicle, with a difference between the received relative speed and the detected relative speed being equal to or less than a predetermined threshold and a difference between the received relative position and the detected relative position being also within a particular distance, is determined as the other vehicle transmitting the vehicle information used for calculation of the received relative speed and the detected relative position.

The method for associating the other vehicle receiving the vehicle information with the other vehicle detected by the periphery monitoring system 3 is not limited to the example, and other known methods may be applicable.

In the embodiment, in a variety of processing to be described below, the values detected by the periphery monitoring system 3 are used as the relative position, relative speed, positional information, vehicle speed or the like of the other vehicle having the vehicle ID associated with the detection vehicle ID. That is, the detected relative position and the detected relative speed are employed as the relative position and relative speed of the other vehicle, and the positional information of the other vehicle is specified from the detected relative position and positional information of the subject vehicle detected by the subject-vehicle position detection section F1. Also as the vehicle speed of the other vehicle, a value obtained from the vehicle speed of the subject vehicle and the detected relative speed is employed. The same is applied to other parameters such as acceleration.

As another mode, when vehicle information received from the other vehicle is reliable for use, a value included in the vehicle information received from the vehicle may be used as information indicating a traveling state of the other vehicle. That is, as the positional information or vehicle speed of the other vehicle, a value included in the vehicle information from the other vehicle may be employed.

As the traveling direction of the other vehicle, a value included in the vehicle information received from the other vehicle may be employed, or a value calculated from time-series data of positional information of the other vehicle may be employed.

Of the other vehicles receiving the vehicle information, the target-vehicle setting section F5 performs processing (referred to as target-vehicle setting processing) of setting the other vehicle as a processing target (referred to as a target vehicle) in the another-driver recognition state determination processing and the recognition information transmission-related processing. This target-vehicle setting processing is described with reference to a flowchart shown in FIG. 5.

FIG. 5 is a flowchart showing an example of the target-vehicle setting processing performed by the target-vehicle setting section F5. The target-vehicle setting processing shown in FIG. 5 is performed, for example, when the vehicle information reception processing section F32 receives vehicle information from another vehicle. In addition, the processing may be performed successively (for example, every 100 milliseconds) on each of the multiple other vehicles registered in the surrounding vehicle list.

First, in S101, it is determined whether the other vehicle transmitting the vehicle information is another vehicle traveling on an oncoming lane, based on the received vehicle information.

It may be determined whether the other vehicle is the other vehicle traveling on the oncoming lane by comparing the traveling direction of the other vehicle included in the received vehicle information with the traveling direction of the subject vehicle. For example, when an angle formed by the traveling direction of the other vehicle and the traveling direction of the subject vehicle is equal to or greater than a predetermined threshold (referred to as an oncoming-vehicle determination threshold), the other vehicle is determined to be the other vehicle traveling on the oncoming lane. The oncoming-vehicle determination threshold may be designed as appropriate, for example, 170 degrees.

When the other vehicle transmitting the vehicle information is determined to be the other vehicle traveling on the oncoming lane (YES in S101), the processing proceeds to S104. On the other hand, when the other vehicle transmitting the vehicle information is determined not to be the other vehicle traveling on the oncoming lane (NO in S101), the processing proceeds to S102.

In S102, based on the positional information included in the vehicle information and the positional information of the subject vehicle, it is determined whether the other vehicle transmitting the vehicle information is present within a predetermined distance (referred to as a target-vehicle setting distance) from the subject vehicle. The target-vehicle setting distance may be a fixed value, such as 50 m, or a value that is set in accordance with the vehicle speed of the subject vehicle. In the latter case, the setting is made such that the larger the relative speed with respect to the target vehicle, the larger the target-vehicle setting distance.

When the other vehicle transmitting the vehicle information is present within the target-vehicle setting distance with respect to the subject vehicle (YES in S102), the processing proceeds to S103. On the other hand, when the other vehicle transmitting the vehicle information is not present within the target-vehicle setting distance with respect to the subject vehicle (NO in S102), the processing proceeds to S104.

In S103, the other vehicle is set as the target vehicle, and the processing flow is completed. More specifically, in the surrounding vehicle list, a target vehicle flag of the other vehicle transmitting the vehicle information is set to 1. The target vehicle flag is a flag for distinguishing the other vehicle to be the target vehicle from the other vehicle (referred to as a non-target vehicle) not to be the target vehicle. The target vehicle flag is set to 1 with respect to the other vehicle to be the target vehicle. Meanwhile, the vehicle with the target vehicle flag set to 0 means a non-target vehicle.

In S104, the other vehicle is set as the non-target vehicle, and the processing flow is completed. That is, in the surrounding vehicle list, the target vehicle flag of the other vehicle transmitting the vehicle information is set to 0.

As described above, setting in advance whether the other vehicle present on the periphery of the subject vehicle is the other vehicle enables reduction in processing load in another-driver recognition state determination processing and recognition information transmission-related processing which are described later. That is, the foregoing target-vehicle setting processing is processing for reducing the processing load in the another-driver recognition state determination processing and the recognition information transmission-related processing, and is not essential processing.

The embodiment shows the example of distinguishing the target vehicle from the non-target vehicle by use of the difference in traveling direction between the subject vehicle and the other vehicle, or the distance between the subject vehicle and the other vehicle; however, the disclosure is not limited to this configuration. For example, a type of a road where the subject vehicle is traveling, a traveling route, intersection information, or the like may be used to distinguish the target vehicle from the non-target vehicle.

Moreover, in the embodiment, the vehicle traveling on the oncoming lane and the other vehicle away from the subject vehicle by not smaller than the target-vehicle setting distance are not set as the target vehicles, and other vehicles except for the above vehicle are set as the target vehicle. However, the invention is not limited to this configuration. All of the other vehicles present within the target-vehicle setting distance with respect to the subject vehicle may be set as the target vehicles regardless of the traveling directions of the vehicles. That is, the flowchart shown in FIG. 5 is an example. A condition for the target vehicle may be designed as appropriate.

In addition to the oncoming vehicle, a vehicle that can be determined to have no possibility for physically meeting the subject vehicle is determined as the non-target vehicle. The vehicle having no possibility for physically meeting the subject vehicle is, for example, a vehicle in the relationship between a vehicle traveling on an urban expressway and a vehicle traveling on a general road in a section where the urban expressway and the general road extend side by side. That is, when the subject vehicle is traveling on the general road extending beside the expressway, there can be present a vehicle traveling in the same traveling direction as that of the subject vehicle among the other vehicles traveling on the expressway. However, there is no possibility for the subject vehicle traveling on the general road and the other vehicle traveling on the expressway to physically meet each other. Accordingly, such a vehicle is preferably set as a non-target vehicle.

Whether vehicles are in the relationship between a vehicle traveling on the urban expressway and a vehicle traveling on the general road may be determined by use of a variety of methods. For example, when information of types of the road (the expressway and the general road) on which the respective vehicles are traveling is included in the vehicle information transmitted and received in the vehicle-to-vehicle communication, it may be determined whether the vehicles are those satisfying such relationship as described above, by using the information. When the positional information includes information of a height direction in addition to longitude and latitude, it may be determined whether the vehicles have the possibility for physically meeting each other, from a difference between heights at which the subject vehicle and the other vehicle are present. When the difference in height is equal to or greater than a predetermined threshold, it means that the vehicles are in the relationship between a vehicle traveling on the urban expressway and a vehicle traveling on the general road, or that the vehicles are present on different floor levels in a multi-story parking lot. In either case, it can be said that there is no possibility for the vehicles to physically meet each other.

On the contrary, near an intersection, even when the traveling direction of the other vehicle forms a particular angle difference from the traveling direction of the subject vehicle, the other vehicle can be determined to have the possibility for physically meeting the subject vehicle. This is because vehicles traveling in a variety of directions meet at the intersection.

The visual line detection section F6 successively acquires image data photographed by the driver monitor 5 and detects characteristic points from the image data by use of a known image processing technique to detect a face region, and an eye region, a pupil portion or the like in the face region. The driver monitor 5 of the embodiment is installed so as to be fixed to the subject vehicle, and the image capturing direction is also fixed. Hence, it is possible to specify a position of the face of the driver inside the subject vehicle in accordance with a position and a size of the face region in the image data. The visual line detection section F6 detects a visual line direction of the driver from the size of the face region, and the position of the eye region and the position of the pupil in the face region.

As more detailed functional blocks, the recognition determination section F7 includes an another-driver recognition state determination section F71 and a subject-driver recognition state determination section F72. The another-driver recognition state determination section F71 determines the state of recognition of the subject vehicle by the other driver. In the embodiment, the another-driver recognition state determination section F71 distinguishes the state of recognition of the subject vehicle by the other driver into three states: recognized, unrecognized, and unclear states.

A case where the state of recognition of the subject vehicle by the other driver is the recognized state indicates a case where the other driver recognizes the subject vehicle. A case where the state of recognition of the subject vehicle by the other driver is the unrecognized state indicates a case where the other driver does not recognize the subject vehicle. A case where the state of recognition of the subject vehicle by the other driver is the unclear state indicates a case where a recognition information signal is not received from the other vehicle and information indicating the state of recognition of the subject vehicle by the other driver (that is, recognition information) is not obtained. As thus described, the case where the state of recognition of the subject vehicle by the other driver is unclear means a case where the vehicle onboard system 10 is not mounted in the other vehicle, or some other case. The another-driver recognition state determination section F71 is described in detail below in a description of the another-driver recognition state determination processing.

The subject-driver recognition state determination section F72 determines the state of recognition of the other vehicle by the subject driver and makes the recognition information transmission processing section F33 create and transmit recognition information based on the recognition state. The state of recognition of the other vehicle by the subject driver is represented by whether the subject driver recognizes the presence of the other vehicle, that is, by either the recognized state or the unrecognized state.

The informing control section F8 performs processing of informing the driver of a variety of pieces of information via the display device 6 and the sound output device 7. For example, based on the recognition information signal received from the other vehicle, the informing control section F8 displays on the display device 6 information indicating whether the driver of the other vehicle recognizes the subject vehicle or the like.

The informing control section F8 displays on the display device 6 an image and a text for prompting the driver of the subject vehicle to view a direction in which the other vehicle to be informed to the driver is present, or an image or a text for informing the driver of the presence of the other vehicle approaching the subject vehicle. The other vehicle to be informed to the driver corresponds to the other vehicle which is in a viewable range of the subject vehicle and is not recognized by the driver, and some other vehicle.

The informing control section F8 performs informing to the driver via not only the display device 6 but also the sound output device 7. The informing control section F8 may prompt the driver of the subject vehicle to view a direction to pay attention to by lighting a light device (not shown) provided on the door mirror, or by some other method. The operation of the informing control section F8 is mentioned in descriptions of flowcharts shown in FIG. 6 and FIG. 7.

Figure 6:
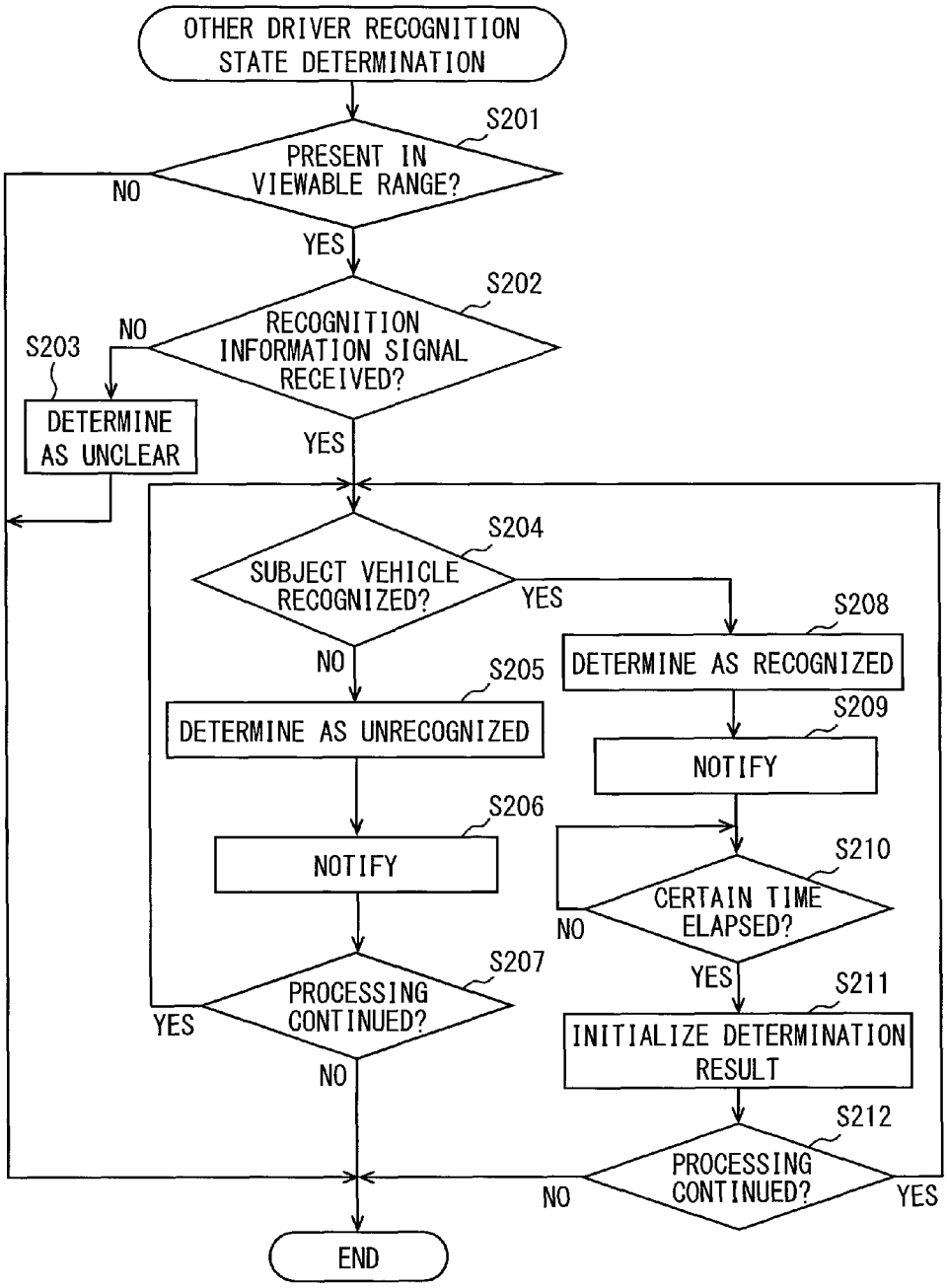
FIG. 6 is a flowchart showing an example of another driver recognition state determination processing that is performed by the controller.

With reference to a flowchart shown in FIG. 6, a description is given of the another-driver recognition state determination processing performed by the controller 1. The another-driver recognition state determination processing is performed mainly by the another-driver recognition state determination section F71 among the functional blocks included in the controller 1. As for a processing step that is performed by the another-driver recognition state determination section F71 among the processing steps included in the another-driver recognition state determination processing, a description of a main constituent that performs the processing step is omitted.

The flowchart shown in FIG. 6 is performed successively (every 100 milliseconds), for example. The following processing is sequentially performed for each of the other vehicles that are the target vehicles in the surrounding vehicle list. Hence, the target vehicle in the following description indicates any one of the other vehicles set as the target vehicles in the surrounding vehicle list.

First, in S201, based on the positional information of the subject vehicle and the positional information of the target vehicle, it is determined whether the subject vehicle is present within a viewable range of the target vehicle. The viewable range of the target vehicle is a range that is defined based on in advance designed viewable range definition data, the positional information, and the traveling direction. For example, the viewable range may be a range within a predetermined distance (for example, 50 meters) in a longitudinal direction of the vehicle, and within a predetermined distance (for example, 20 meters) in a width direction of the vehicle, taking a point shown by the positional information as a standard. The longitudinal direction and the width direction of the vehicle may be defined from the traveling direction.

The viewable range definition data may be previously designed such that a viewable range that is defined based on the viewable range definition data is a range expected to be viewable by the driver. For example, the viewable range data may be designed such that the viewable range includes not only a range that enters the sight of the driver in posture facing the front direction of the vehicle, but also a range directly viewable by the driver by turning his or her body or face. The viewable range definition data may be set such that the viewable range includes a range indirectly viewable by the driver via the door mirror or the rear-view mirror. Moreover, the viewable range definition data may be set based on a range detectable by the periphery monitoring system 3.

In addition to the viewable range definition data, the viewable range may be set based on a parameter (referred to as a sight parameter) that has an effect on a sight distance of the driver, such as a weather condition like raining, snowing, fogging, or the like, or whether it is in the night time. For example, in the case of a raining, snowing, or fogging condition, the sight distance of the driver is short as compared with a case of a fine condition or the like. Accordingly, in the case of the raining, snowing, or fogging condition, the viewable range may be set so as to be smaller than that in the normal time. The sight distance of the driver in the night time reduces in the daytime. Hence, the viewable range in the night time is set so as to be smaller than that in the daytime.

Whether it is the night time or not may be determined based on time information, or may be determined from an output value of a sunshine sensor. The weather condition may be acquired from a center provided outside the vehicle, or may be acquired from a rain sensor.

The viewable range data is used not only when the viewable range of the target vehicle is defined, but also when the viewable range of the subject vehicle is defined. That is, the viewable range of the subject vehicle can be uniquely defined based on the positional information, traveling direction, and viewable range definition data of the subject vehicle. The viewable range definition data is stored in the memory 11.

When the subject vehicle is present in the viewable range of the target vehicle (YES in S201), the processing proceeds to S202. On the other hand, when the subject vehicle is not present in the viewable range of the target vehicle (NO in S201), the processing flow is completed.

In the embodiment, when another vehicle is present between the target vehicle and the subject vehicle and the periphery monitoring system 3 of the subject vehicle is not able to detect the target vehicle due to the presence of the other vehicle, it is determined that the subject vehicle is not present in the viewable range of the target vehicle. When the periphery monitoring system 3 of the subject vehicle is not able to detect the target vehicle, it means that the target vehicle as a transmission source of vehicle information is not associated with the other vehicle included in the surrounding vehicle data.

As another mode, the subject vehicle may be determined to be present in the viewable range of the target vehicle even when another vehicle is present between the target vehicle and the subject vehicle and the periphery monitoring system 3 of the subject vehicle is not able to detect the target vehicle.

In S202, it is determined whether the recognition information reception processing section F34 receives the recognition information signal from the target vehicle. When the recognition information signal is received from the target vehicle (YES in S202), the processing proceeds to S204. On the other hand, when the recognition information signal is not received from the target vehicle (NO in S202), the processing proceeds to S203. As an example, when the recognition information signal is not received from the target vehicle within a particular period of time after the determination to be YES in S201, the determination is made to be NO in S202.

In S203, the state of recognition of the subject vehicle by the other driver is determined to be the unclear state, and the processing flow is completed.

In S204, it is determined whether the driver of the target vehicle recognizes the subject vehicle, based on the received recognition information signal. When the driver of the target vehicle recognizes the subject vehicle or when the recognition flag included in the received recognition information signal is 1 (YES in S204), the processing proceeds to S208. On the other hand, when the driver of the target vehicle does not recognize the subject vehicle, that is, when the recognition flag included in the received recognition information signal is 0 (NO in S204), the processing proceeds to S205.

In S205, the state of recognition of the subject vehicle by the other driver is determined to be the unrecognized state, and the processing proceeds to S206. As described above, this case means that the other driver does not recognize the subject vehicle.

In S206, the informing control section F8 informs the subject driver of information indicating that the driver of the target vehicle does not recognize the presence of the subject vehicle, and the processing proceeds to S207. More specifically, the informing control section F8 displays on the display device 6 an image and a text showing that the driver of the target vehicle does not recognize the presence of the subject vehicle. A sound showing that the driver of the target vehicle does not recognize the presence of the subject vehicle may be outputted from the sound output device 7.

In S207, it is determined whether the processing flow is continued. The case of determining the continuation of the processing flow is, for example, a case where the subject vehicle is still present in the viewable range of the target vehicle. The case of determining the non-continuation of the processing flow is, for example, a case where the subject vehicle deviates from the viewable range of the target vehicle.

When the continuation of the processing flow is determined in S207 (YES in S207), the processing proceeds to S204. On the other hand, when the non-continuation of the processing flow is determined in S207 (NO in S207), the processing flow is completed. That is, steps S204 to S207 are repeated until the non-continuation of the processing flow is determined or until the recognition information signal indicating that the driver of the target vehicle recognizes the subject vehicle is received (YES in S204). During that time, the determination that the state of recognition of the subject vehicle by the other driver is the unrecognized state is held.

In S208, the state of recognition of the subject vehicle by the other driver is determined to be the recognized state, and the processing proceeds to S209. As described above, this case means that the other driver recognizes the subject vehicle. In S209, the informing control section F8 informs the subject driver of information indicating that the driver of the target vehicle recognizes the presence of the subject vehicle, and the processing proceeds to S210. More specifically, the informing control section F8 displays on the display device 6 an image and a text showing that the driver of the target vehicle recognizes the presence of the subject vehicle. A sound showing that the driver of the target vehicle recognizes the presence of the subject vehicle may be outputted from the sound output device 7.

In S210, it is determined whether a predetermined period of time (referred to as determination result hold time) elapses after the determination in S208 that the state of recognition of the subject vehicle by the other driver is the recognized state. This determination result hold time is the time during which the determination result as the recognized state is held, and may be designed as appropriate. In the embodiment, the determination result hold time is set to 10 seconds as an example, but may be 5 seconds, 15 seconds, or the like.

When the determination result hold time elapses after the determination in S208 that the state of recognition of the subject vehicle by the other driver is the recognized state (YES in S210), the processing proceeds to S211. On the other hand, when the determination result hold time does not elapse (NO in S210), and S210 is repeated.

In S211, the determination result of the state of recognition of the subject vehicle by the other driver is initialized, that is, the determination result as the recognized state is canceled, and the processing proceeds to S212. In S212, similarly to S207, it is determined whether the processing flow is continued. When the continuation of the processing flow is determined in S212 (YES in S212), the processing proceeds to S204. On the other hand, when the non-continuation of the processing flow is determined in S212 (NO in S212), the processing flow is completed.

Figure 7:
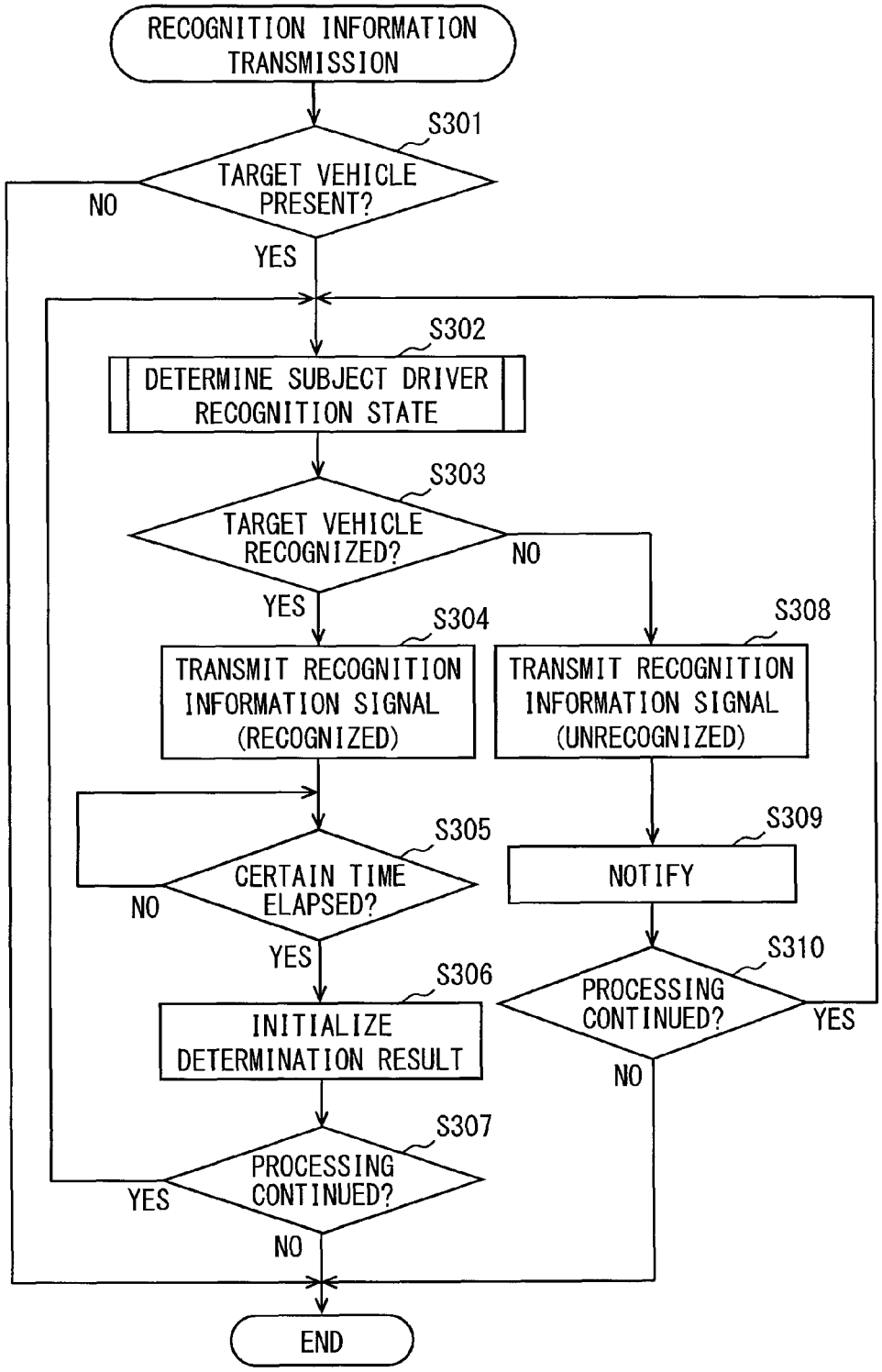
FIG. 7 is a flowchart showing an example of recognition information transmission related processing that is performed by the controller.

Next, with reference to a flowchart shown in FIG. 7, a description is given of the recognition information transmission-related processing performed by the controller 1. This recognition information transmission-related processing is performed mainly by the subject-driver recognition state determination section F72 in cooperation with another functional block (recognition information transmission processing section F33). As for a processing step performed by the subject-driver recognition state determination section F72 among the processing steps included in the recognition information transmission-related processing, a description of a main constituent that performs the processing step is omitted.

The flowchart shown in FIG. 7 is performed successively (every 100 milliseconds), for example. The following processing is also performed for each of all the other vehicles that are the target vehicles in the surrounding vehicle list, similarly to the another-driver recognition state determination processing described above. That is, the target vehicle that is referred to in the description of the flowchart shown in FIG. 7 indicates any one of the other vehicles set as the target vehicles in the surrounding vehicle list.

First, in S301, based on the positional information of the subject vehicle and the positional information of the target vehicle, it is determined whether the target vehicle is present within viewable range of the subject vehicle. The viewable range of the subject vehicle may be calculated based on the positional information and traveling direction of the subject vehicle, and the viewable range definition data registered in the memory 11.

When the target vehicle is present in the viewable range of the subject vehicle (YES in S301), the processing proceeds to S302. On the other hand, when the target vehicle is not present in the viewable range of the subject vehicle (NO in S301), the processing flow is completed.

In the embodiment, when another vehicle is present between the target vehicle and the subject vehicle and the periphery monitoring system 3 of the subject vehicle is not able to detect the target vehicle due to the presence of the other vehicle, it is determined that the target vehicle is not present in the viewable range of the subject vehicle. As another mode, the target vehicle may be determined to be present in the viewable range of the subject vehicle even when another vehicle is present between the target vehicle and the subject vehicle and the periphery monitoring system 3 of the subject vehicle is not able to detect the target vehicle.

In S302, processing (referred to as subject-driver recognition state determination processing) of determining the state of recognition of the target vehicle by the subject driver is performed, and the processing proceeds to S303. With reference to a flowchart shown in FIG. 8, a description is given of the subject-driver recognition state determination processing performed in S302.

Figure 8:
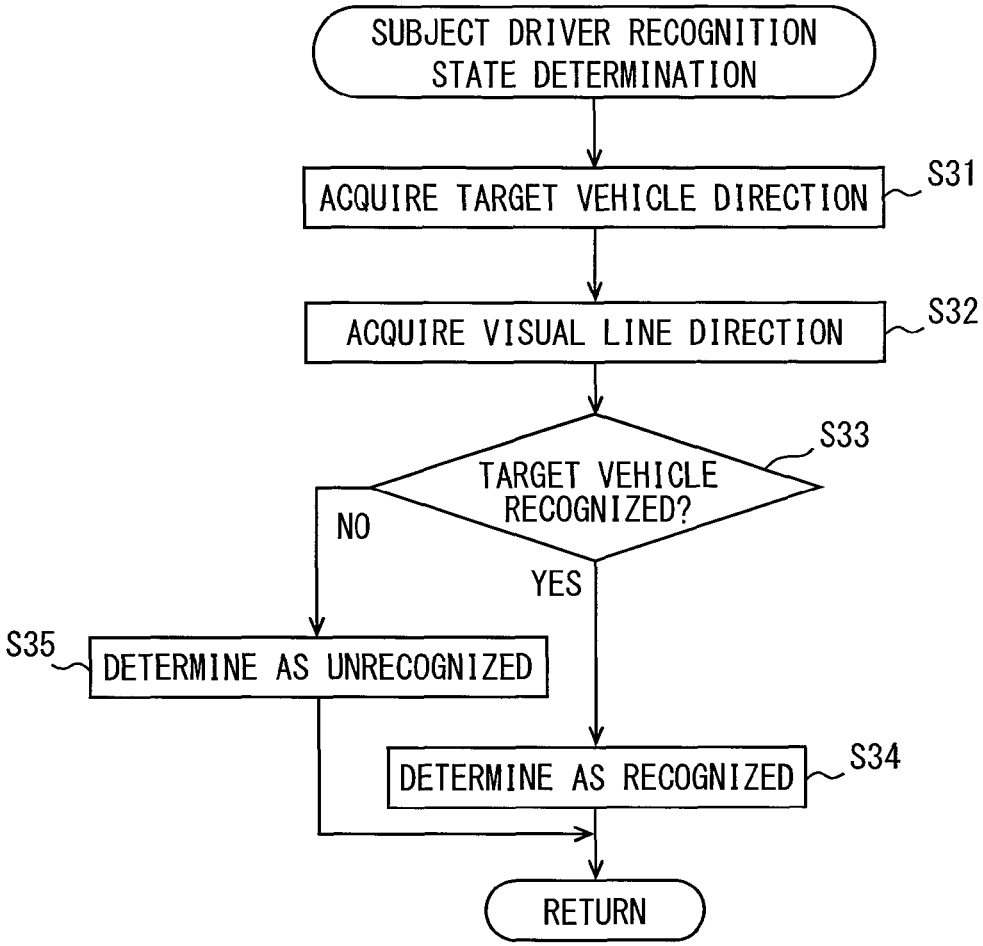
FIG. 8 is a flowchart showing an example of subject driver recognition state determination processing that is performed by a subject driver recognition state determination section.

The flowchart shown in FIG. 8 is started when the processing proceeds to S302 of FIG. 7. As another mode, the processing may be successively performed, and the recognition state obtained as a result of the processing may be held in association with the other vehicle.

First, in S31, the relative position of the target vehicle with respect to the subject vehicle is acquired, and a direction (referred to as a target vehicle direction) in which the target vehicle is present is acquired. In S32, a visual line direction of the subject driver, which is detected by the visual line detection section F6, is acquired.

In S33, based on the visual line direction of the subject driver which is detected by the visual line detection section F6, it is determined whether the subject driver recognizes the target vehicle. For example, when the time during which the visual line direction of the subject driver which is acquired in S32 matches with the target vehicle direction acquired in S31 is not shorter than a particular period of time (referred to as visual-recognition determination time), it is determined that the subject driver recognizes the target vehicle. The visual-recognition determination time may be designed as appropriate and is 1.5 seconds here.

In a case where the subject driver is present in a range that can be indirectly seen by the subject driver via the door mirror, when the time during which the visual line direction of the subject driver is a direction in which the door mirror corresponding to the target vehicle existing side is provided is not shorter than the visual-recognition determination time, it is determined that the subject driver recognizes the target vehicle.

The range that can be indirectly seen by the subject driver via the door mirror may be determined, for example, based on the position of the head of the driver which is detected by the driver monitor 5, and an angle of the door mirror which is detected by a door mirror angle sensor. A position of a head rest of the driver's seat may be used in place of the position of the head of the driver. The position of the head rest of the driver's seat may be set based on an output value of a seat position sensor for detecting the position of the driver's seat or may be set based on a standard seat position.

In a case where the periphery monitoring system 3 includes a camera (for example, rear-view camera) for photographing the periphery of the subject vehicle and displays on the display device 6 an image photographed by the camera and including the target vehicle, when the time during which the visual line direction of the subject driver matches with the direction of installation of the display device 6 is not shorter than the visual-recognition determination time, it may be determined that the subject driver recognizes the target vehicle.

When it is determined that the subject driver recognizes the target vehicle (YES in S33), the processing proceeds to S34. When it is determined that the subject driver does not recognize the target vehicle (NO in S33), the processing proceeds to S35.

In S34, the state of recognition of the target vehicle by the subject driver is determined to be the recognized state, and the processing returns to the recognition information transmission-related processing of FIG. 7. In S35, the state of recognition of the target vehicle by the subject driver is determined to be the unrecognized state, and the processing returns to the recognition information transmission-related processing of FIG. 7.

Returning to the flowchart of FIG. 7, a further description is given of the recognition information transmission-related processing. In S303, as a result of the subject-driver recognition state determination processing performed in S302, it is determined whether the state of recognition of the target vehicle by the subject driver is the recognized state. When the state of recognition of the target vehicle by the subject driver is the recognized state (YES in S303), the processing proceeds to S304. On the other hand, when the state of recognition of the target vehicle by the subject driver is the unrecognized state (NO in S303), the processing proceeds to S308.

In S304, the recognition information transmission processing section F33 transmits to the target vehicle a recognition information signal indicating that the subject driver recognizes the target vehicle. That is, the recognition information signal with the recognition flag set to 1 is transmitted to the target vehicle. When the processing is completed in S304, the processing proceeds to S305.

In S305, it is determined whether the determination result hold time elapses after transmission of the recognition information signal. When the determination result hold time elapses after transmission of the recognition information signal (YES in S305), the processing proceeds to S306. On the other hand, when the determination result hold time does not elapse after transmission of the recognition information signal (NO in S305), S305 is repeated and the processing stands by until the determination result hold time elapses. In S306, the state of recognition of the target vehicle by the subject driver is returned to the unrecognized state (that is, initialized), and the processing proceeds to S307.

In S307, it is determined whether the processing flow continues. The case of determining the continuation of the processing flow is, for example, a case where the target vehicle is still present in the viewable range of the subject vehicle. The case of determining the non-continuation of the processing flow is, for example, a case where the target vehicle deviates from the viewable range of the subject vehicle.

When the continuation of the processing flow is determined in S307 (YES in S307), the processing proceeds to S302. On the other hand, when the non-continuation of the processing flow is determined in S307 (NO in S307), the processing flow is completed.

In S308, the recognition information transmission processing section F33 transmits to the target vehicle a recognition information signal indicating that the subject driver does not recognize the target vehicle. That is, the recognition information signal with the recognition flag set to 0 is transmitted to the target vehicle. When the processing is completed in S308, the processing proceeds to S309.

In S309, informing processing of prompting the subject driver to recognize the target vehicle is performed, and the processing proceeds to S310. More specifically, the informing control section F8 displays on the display device 6 information with contents that prompt viewing of the target vehicle direction. The informing control section F8 may output from the sound output device 7 a sound that prompts viewing of the target vehicle direction. The informing control section F8 may prompt the driver of the subject vehicle to view the target vehicle direction by lighting a light device (not shown) provided on the door mirror on the target vehicle existing side, or by some other method.

In S310, similarly to S307, it is determined whether the processing flow is continued. When the continuation of the processing flow is determined in S310 (YES in S310), the processing proceeds to S302. On the other hand, when the non-continuation of the processing flow is determined in S310 (NO in S310), the processing flow is completed.

Figure 9:
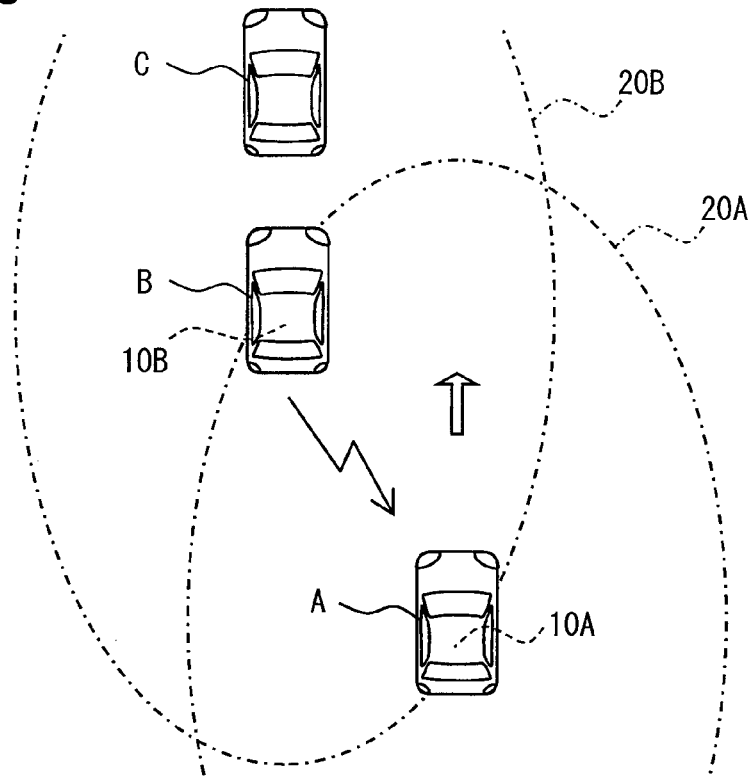
FIG. 9 is a diagram explaining operations and effects of the vehicle onboard system in the embodiment.

Next, operations and effects of the vehicle recognition notification system are described with reference to FIG. 9. FIG. 9 is a schematic view showing a situation where a vehicle A attempts to overtake a vehicle B. A vehicle C is a preceding vehicle for the vehicle B. A lane on which the vehicle B travels is assumed to be crowded as compared with a lane on which the vehicle A travels. The vehicle onboard systems 10A and 10B are respectively mounted in the vehicles A and B.

In FIG. 9, a dashed line 20A shows a viewable range of the vehicle A and a dashed line 20B shows a viewable range of the vehicle B. That is, FIG. 9 represents the time point at which the vehicle A enters the viewable range of the vehicle B and the vehicle B enters the viewable range of the vehicle A. For the sake of convenience, the following description is given assuming that the vehicle A receives a recognition information signal from the vehicle B and the vehicle B transmits the recognition information signal to the vehicle A. It is assumed that the vehicle A is a subject vehicle and the vehicle B is another vehicle for the subject vehicle A.

First, as the subject vehicle A enters the viewable range of the other vehicle B (YES in S201), the vehicle onboard system 10A of the subject vehicle A waits for the recognition information signal to be transmitted from the other vehicle B (that is, the vehicle onboard system 10A comes into a reception waiting state). Upon reception of the recognition information signal from the other vehicle B (YES in S202), the another-driver recognition state determination section F71 of the vehicle A determines whether the driver of the other vehicle B recognizes the subject vehicle A, based on the recognition information signal (S204).

When the subject-driver recognition state determination section F72 of the other vehicle B determines that the driver of the other vehicle B recognizes the vehicle A (YES in S303), the vehicle B transmits a recognition information signal indicating that the driver of the vehicle B recognizes the vehicle A (S304). That is, the recognition information signal received by the vehicle A has contents showing that the driver of the vehicle B recognizes the vehicle A (YES in S204). Then, the informing control section F8 of the vehicle A informs the driver of the vehicle A that the driver of the vehicle B recognizes the vehicle A, via the display device 6, the sound output device 7, or the like (S209).

That is, according to the above configuration, the driver of the subject vehicle A can perceive that the driver of the other vehicle recognizes the subject vehicle A.

When the subject-driver recognition state determination section F72 of the other vehicle B determines that the driver of the other vehicle B does not recognize the vehicle A (NO in S303), the vehicle B transmits a recognition information signal indicating that the driver of the vehicle B does not recognize the vehicle A (S308). That is, the recognition information signal received by the vehicle A has contents showing that the driver of the vehicle B does not recognize the vehicle A (NO in S204). Then, the informing control section F8 of the vehicle A informs the driver of the vehicle A that the driver of the vehicle B does not recognize the vehicle A, via the display device 6, the sound output device 7, or the like (S206).

That is, according to the above configuration, the driver of the subject vehicle A can perceive that the driver of the other vehicle does not recognize the subject vehicle A. For example, in the situation of FIG. 9, the driver of the subject vehicle knows that the driver of the other vehicle B attempting to overtake the subject vehicle does not recognize the subject vehicle, thereby making a prediction that the other vehicle B may suddenly change lanes to the lane on which the subject vehicle A travels, or some other prediction.

In the embodiment, when the another-driver recognition state determination section F71 of the vehicle A does not receive the recognition information signal from the vehicle B after an elapse of a particular period of time from the entry of the vehicle B into the viewable range (NO in S202), then the another-driver recognition state determination section F71 of the vehicle A determines that it is unclear whether the driver of the vehicle B recognizes the subject vehicle (S203) and informs the driver of the vehicle A of the fact.

Accordingly, the driver of the subject vehicle A can obtain the information that it is unclear whether the driver of the other vehicle B recognizes the presence of the subject vehicle A. When it is unclear whether the driver of the other vehicle B recognizes the presence of the subject vehicle A, the driver of the vehicle A can make a prediction that the vehicle B may suddenly change lanes to the lane on which the subject vehicle A travels, or some other prediction, as in the case where the driver of the vehicle B does not recognize the subject vehicle A.

In the embodiment, when the determination result hold time elapses after the another-driver recognition state determination section F71 of the subject vehicle A once determines that the driver of the other vehicle B recognizes the subject vehicle A, the another-driver recognition state determination section F71 of the subject vehicle A cancels the determination result. Then, the another-driver recognition state determination section F71 of the subject vehicle A determines the state of recognition of the subject vehicle A by the driver of the other vehicle B again. Accordingly, when the state where the subject vehicle A and the other vehicle B travels side by side continues for not shorter than the determination result hold time and the driver of the other vehicle B has low consciousness of the subject vehicle A, the state can be returned to the unrecognized state.

The operations and effects of the embodiment are described above, taking the vehicle A as the subject vehicle and the vehicle B as the other vehicle in FIG. 9. However, the standpoints of these vehicles may be changed from each other. Hereinafter, a description is given of operations and effects of the vehicle B in a case where the vehicle A is taken as the other vehicle and the vehicle B as the subject vehicle.

First, when the vehicle onboard system 10B of the subject vehicle B receives the entry of the other vehicle A into the viewable range of the subject vehicle B (YES in S301), the subject-driver recognition state determination section F72 performs the subject-driver recognition state determination processing (S302) to determine whether the driver of the subject vehicle B recognizes the other vehicle A. When it is determined that the driver of the subject vehicle B recognizes the other vehicle A (YES in S303), a recognition information signal indicating that the driver of the subject vehicle B recognizes the other vehicle A is transmitted to the other vehicle A.

That is, according to the configuration of the embodiment described above, it is possible to notify the other vehicle A that the driver of the subject vehicle B recognizes the other vehicle A.

When the subject-driver recognition state determination section F72 determines that the driver of the subject vehicle B does not recognize the other vehicle A (NO in S303), the informing control section F8 performs informing that prompts the driver of the subject vehicle B to confirm the presence of the other vehicle A. This configuration allows the driver of the vehicle B to easily recognize the other vehicle A.

When the driver of the subject vehicle B does not recognize the other vehicle A and the other vehicle A is present within the viewable range of the subject vehicle B (YES in S310), the subject-driver recognition state determination processing is successively performed. Thus, when the driver of the subject vehicle B recognizes the other vehicle A thereafter, the recognition information signal indicating that the driver of the subject vehicle B recognizes the other vehicle A is transmitted to the other vehicle A.

In the above description, in the combination between the vehicle A and the vehicle B, one of the vehicles transmits the recognition information signal, and the other vehicle receives the recognition information signal. However, the vehicle A and the vehicle B may each transmit the recognition information signal to each other. That is, the vehicle A may receive the recognition information signal from the vehicle B and may also transmit the recognition information signal to the vehicle B.

In the above description, the example of transmitting and receiving the recognition information signal in the overtaking or overtaken situation is shown. However, the above configuration can be applied to other situations. For example, in the situation of entering an intersection, the awareness of the drivers can be harmonized with each other by transmission and reception of the recognition information signals, to reduce the possibility of collision near the intersection. The embodiment of the disclosure is described above, but the disclosure is not limited to the foregoing embodiment, and modifications described hereinafter are also included in the technical scope of the disclosure. In addition to the modifications below, a variety of modifications can be made within a scope not deviating from the gist of the disclosure, and the modified one can be performed.

(First Modification)

Figure 10A:
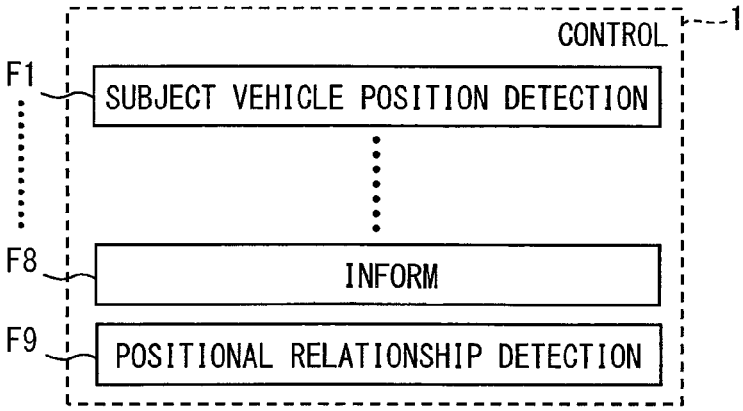
FIG. 10A is a block diagram showing an example of a schematic configuration of a controller in a first modification.
Figure 10B:
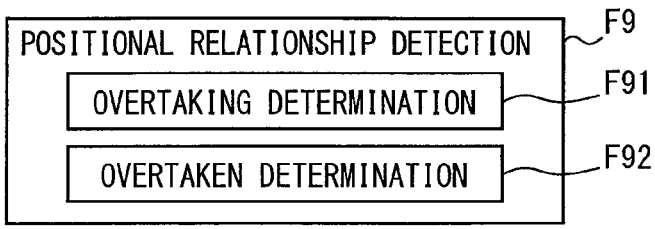
FIG. 10B is a block diagram showing an example of a schematic configuration of a positional relationship change detection section in the first modification.

A controller 1 in a first modification includes a positional relationship change detection section F9 in addition to the foregoing functional blocks (F1 to F8) as shown in FIG. 10A and FIG. 10B. The positional relationship change detection section F9 detects a behavior of at least either the subject vehicle or the other vehicle attempting to change the positional relationship between the vehicles, from the relative position of the subject vehicle with respect to the other vehicle traveling on the periphery of the subject vehicle, and a temporal change in the relative position. The change in positional relationship here indicates changing a vehicle to be a preceding vehicle or changing a vehicle to be a following vehicle. In addition, the temporal change in relative position here may be represented by a relative speed. The temporal change in relative position may be represented by relative acceleration that is set by differentiating the relative speed by time.

The positional relationship change detection section F9 includes an overtaking determination section F91 and an overtaken determination section F92 as more detailed functional blocks. Processing performed by the positional relationship change detection section F9 is performed on each of the other vehicles traveling on the periphery of the subject vehicle. The other vehicles traveling on the periphery of the subject vehicle may be the other vehicles detected by the periphery monitoring system 3 or may be the other vehicles present in the viewable range of the subject vehicle.

The overtaking determination section F91 determines whether the subject vehicle attempts to overtake the other vehicle. As a situation where the subject vehicle overtakes the other vehicle, there can be considered the case of overtaking the other vehicle traveling in front of the subject vehicle in a lane on which the subject vehicle travels (referred to as a subject-vehicle traveling lane), or the case of overtaking the other vehicle traveling in front of the subject vehicle in a lane (referred to as adjacent lane) being adjacent to the subject-vehicle traveling lane and having the same traveling direction as that of the subject-vehicle traveling lane.

Herein, as an example, a description is given of processing in a case where the overtaking determination section F91 determines whether the subject vehicle attempts to overtake the other vehicle traveling on the lane traveling in front of the subject vehicle in the adjacent lane. Hereinafter, of the other vehicles traveling in front of the subject vehicle on the subject-vehicle traveling lane, the other vehicle nearest the subject vehicle is referred to as a front preceding vehicle. Of the other vehicles traveling in front of the subject vehicle on the adjacent lane, the other vehicle nearest the subject vehicle is referred to as a side preceding vehicle. A known lane detection technique may be applied to determine whether the other vehicle travels on the same lane.

First, the overtaking determination section F91 determines whether the other vehicle is the side preceding vehicle, from the relative position of the other vehicle with respect to the subject vehicle. Next, when the other vehicle is the side preceding vehicle, the overtaking determination section F91 determines whether the subject vehicle can overtake the other vehicle on the subject-vehicle traveling lane while remaining traveling on the subject-vehicle traveling lane. The case where the subject vehicle can overtake the other vehicle while remaining traveling on the subject-vehicle traveling lane is a case where the front preceding vehicle is not present on the subject-vehicle traveling lane to at least a region on the side of the other vehicle, or some other case. When it is determined that the subject vehicle can overtake the other vehicle, it is then determined whether the subject vehicle attempts to overtake the other vehicle, from the temporal change in relative position between the subject vehicle and the other vehicle.

Herein, the case where it is determined that the subject vehicle attempts to overtake the other vehicle is a case where a distance between the subject vehicle and the other vehicle decreases with the lapse of time, that is, a case where the subject vehicle approaches the other vehicle, or some other case. The case where the subject vehicle approaches the other vehicle means a case where the relative speed of the other vehicle with respect to the subject vehicle is minus. Hence it may be determined that the subject vehicle attempts to overtake the other vehicle when the relative speed of the other vehicle with respect to the subject vehicle is minus. Moreover, it may be determined that the subject vehicle attempts to overtake the other vehicle when the relative acceleration of the other vehicle with respect to the subject vehicle is minus.

As described above, the overtaking determination section F91 determines whether the subject vehicle attempts to overtake the side preceding vehicle. Then, based on the determination made by the overtaking determination section F91 that the subject vehicle attempts to overtake the side preceding vehicle, the another-driver recognition state determination section F71 starts the another-driver recognition state determination processing for the other vehicle which the subject vehicle attempts to overtake. When the overtaking determination section F91 determines that the subject vehicle attempts to overtake the side preceding vehicle, the controller 1 does not perform the recognition information transmission-related processing for the other vehicle which the subject vehicle attempts to overtake. Accordingly, the subject-driver recognition state determination section F72 does not perform the subject-driver recognition state determination processing on the other vehicle.

The foregoing description concerns the processing performed when the overtaking determination section F91 determines whether the subject vehicle attempts to overtake the other vehicle corresponding to the side preceding vehicle. However, also as for processing of determining whether the subject vehicle attempts to overtake the other vehicle corresponding to the front preceding vehicle, a condition for determining whether the subject vehicle attempts to overtake the other vehicle may be designed as appropriate.

When the subject vehicle attempts to overtake the other vehicle corresponding to the front preceding vehicle, after changing the lanes, the subject vehicle comes into the same situation as the situation where the subject vehicle attempts to overtake the other vehicle corresponding to the side preceding vehicle. Hence it is also possible to apply a determination condition similar to that in the processing described above also to the processing of determining whether the subject vehicle attempts to overtake the front preceding vehicle.

The overtaken determination section F92 determines whether the subject vehicle is attempted to be overtaken by the other vehicle, that is, the other vehicle attempts to overtake the subject vehicle. As a situation where the subject vehicle is overtaken by the other vehicle, there can be considered the case of being overtaken by the other vehicle traveling behind the subject vehicle on the subject-vehicle traveling lane or the case of being overtaken by the other vehicle traveling behind the subject vehicle in the adjacent lane.

Herein, as an example, a description is given of processing in a case where the overtaken determination section F92 determines whether the subject vehicle attempts to overtake the other vehicle traveling on the adjacent lane. Hereinafter, of the other vehicles traveling behind the subject vehicle on the subject-vehicle traveling lane, the other vehicle nearest the subject vehicle is referred to as a rear following vehicle. Of the other vehicles traveling behind the subject vehicle on the adjacent lane, the other vehicle nearest the subject vehicle is referred to as a side following vehicle.

First, the overtaken determination section F92 determines whether the other vehicle is the side following vehicle, from the relative position of the other vehicle with respect to the subject vehicle. When the other vehicle is the side following vehicle, it is determined whether the other vehicle can overtake the subject vehicle. A case where the other vehicle can overtake the subject vehicle is a case where the other vehicle different from the above other vehicle is not present on the lane on which the side following vehicle travels, from a region corresponding to the side of the subject vehicle to a region corresponding to the diagonally front of the subject vehicle. When it is determined that the other vehicle can overtake the subject vehicle, it is then determined whether the other vehicle attempts to overtake the subject vehicle, from the temporal change in relative position between the subject vehicle and the other vehicle.

Herein, the case where it is determined that the other vehicle attempts to overtake the subject vehicle is a case where a distance between the subject vehicle and the other vehicle decreases with the lapse of time, that is, a case where the other vehicle approaches the subject vehicle, or some other case. The case where the other vehicle approaches the subject vehicle means a case where the relative speed of the other vehicle with respect to the subject vehicle is plus. Moreover, it may be determined that the other vehicle attempts to overtake the subject vehicle in a case where the relative acceleration of the other vehicle with respect to the subject vehicle is plus.

As described above, the overtaken determination section F92 determines whether the side following vehicle attempts to overtake the subject vehicle, that is, the subject vehicle is attempted to be overtaken by the rearward following vehicle. Then, based on the determination made by the overtaken determination section F92 that the subject vehicle is attempted to be overtaken by the side following vehicle, the subject-driver recognition state determination section F72 starts the subject-driver recognition state determination processing for the other vehicle attempting to overtake the subject vehicle.

When the overtaken determination section F92 determines that the subject vehicle is attempted to be overtaken by the side following vehicle, the another-driver recognition state determination processing for the other vehicle attempting to overtake the subject vehicle is not performed.

The above description concerns the processing performed when the overtaken determination section F92 determines whether the other vehicle corresponding to the side following vehicle attempts to overtake the subject vehicle. However, also as for processing of determining whether the other vehicle corresponding to the rear following vehicle attempts to overtake the subject vehicle, a condition for determining whether the other vehicle attempts to overtake the subject vehicle may be designed as appropriate.

According to the configuration of the first modification described above, in the combination of the subject vehicle and the other vehicle attempting to change such positional relationship as a preceding vehicle and a following vehicle, it is possible to distinguish between a vehicle to be on the side of transmitting the recognition information signal and a vehicle to be on the side of receiving the recognition information signal.

For example, when the subject vehicle attempts to overtake the other vehicle corresponding to the side preceding vehicle, information of whether the driver of the other vehicle recognizes the subject vehicle can be useful for the driver of the subject vehicle, as described in the embodiment. However, the information of whether the driver of the subject vehicle recognizes the other vehicle corresponding to the side preceding vehicle is likely to be not useful for the driver of the side preceding vehicle.

In such a case, when the vehicle onboard system 10 of the subject vehicle transmits a recognition information signal to the other vehicle, information not useful for the driver of the other vehicle is informed, which may be annoying, instead of useful, for the driver of the other vehicle.

In contrast, according to the configuration as in the first modification, a vehicle on the overtaking side (referred to as an overtaking vehicle) does not perform the subject-driver recognition state determination processing for a vehicle which the vehicle attempts to overtake (referred to as an overtaken vehicle) and does not transmit the recognition information signal to the overtaken vehicle. The controller 1 of the overtaken vehicle does not perform the another-driver recognition state determination processing for the overtaking vehicle. Hence it is possible to prevent informing of the state of recognition of the overtaken vehicle by the driver of the overtaking vehicle from being made to the driver of the overtaken vehicle. That is, it is possible to prevent informing of information with low usability for the driver of the overtaken vehicle.

In the above description, as an example, the positional relationship change detection section F9 detects the behavior of the subject vehicle attempting to overtake the other vehicle, and the behavior of the other vehicle attempting to overtake the subject vehicle. However, the behavior of the subject vehicle or the other vehicle attempting to change the positional relationship, the operation being detected by the positional relationship change detection section F9, is not limited to that described above. For example, the positional relationship change detection section F9 may detect an behavior of the subject vehicle or the other vehicle attempting to change lines or an behavior of the subject vehicle attempting to cut into a space between multiple other vehicles having the relationship of the front preceding vehicle and the rear following vehicle. The positional relationship change detection section F9 may detect behaviors of the subject vehicle and the other vehicle attempting to cut into a space between the subject vehicle and the front preceding vehicle, or some other behavior.

These behaviors may be determined based on whether the position of the turning indication lever of the subject vehicle or the other vehicle is a turn-right position or a turn-left position. The position of the turning indication lever of the subject vehicle may be acquired from the turning indication lever position sensor included in the vehicle onboard sensor group 4. The position of the turning indication lever of the other vehicle may be acquired from vehicle information when the position is included in the vehicle information. When the position of the turning indication lever is the turn-right position or the turn-left position, it may be determined that the vehicle attempts to change lanes.

A white line for defining the subject-vehicle traveling lane is detected using the known lane detection technique, and when a behavior of the subject vehicle or the other vehicle approaching the white line or passing over the white line, it may be determined that the vehicle changes the lanes.

When the vehicle attempting to change the lanes is the other vehicle, it may be determined whether the vehicle attempts to cut in from the positional relationship among the other vehicle, the subject vehicle, and the other surrounding vehicles. For example, when the side preceding vehicle present between the front preceding vehicle and the subject vehicle attempts to change the lanes in the traveling direction, it may be determined that the vehicle attempts to cut in.

(Second Modification)

In the embodiment and first modification described above, even when the driver of the subject vehicle does not recognize the other vehicle, the recognition information signal indicating the non-recognition is transmitted to the other vehicle. However, the invention is not limited to this configuration. When the driver of the subject vehicle recognizes the other vehicle, a signal indicating the recognition (referred to as a recognition completion signal) may be transmitted to the other vehicle, and when the driver of the subject vehicle does not recognize the other vehicle, a signal indicating the non-recognition may not be transmitted. This recognition completion signal corresponds to a signal of the disclosure. The same applies to the other vehicle. That is, only when the driver of the other vehicle recognizes the subject vehicle, the other vehicle transmits the recognition completion signal to the subject vehicle.

Upon reception of the recognition completion signal from the other vehicle, the vehicle onboard system 10 of the subject vehicle informs the driver of the subject vehicle that the driver of the other vehicle recognizes the subject vehicle. Also in such a configuration, the driver of the subject vehicle can perceive that the driver of the other vehicle recognizes the subject vehicle.

(Other Modifications)

In the embodiment, the subject vehicle and the target vehicle establish vehicle-to-vehicle communications with each other; however, the disclosure is not limited to this configuration. The communications between the subject vehicle and the other vehicle may be established via a server or the like provided outside the vehicle.

In the above description, the state of recognition of the subject vehicle by the other driver is distinguished into three states: the recognized state, the unrecognized state, and the unclear state; however, the disclosure is not limited to this configuration. The unrecognized state and the unclear state may be put together to use only the recognized state and the unclear states.

In the above description, the subject-driver recognition state determination processing is performed in S302 of the recognition information transmission-related processing of FIG. 7; however, the disclosure is not limited to this configuration. The subject-driver recognition state determination section F72 may successively perform the subject-driver recognition state determination processing independently of the recognition information transmission-related processing, and a result of the determination may be stored in association with a vehicle ID in the surrounding vehicle list or the like. According to such a configuration, in the recognition information transmission-related processing of S302, the state of recognition of the subject driver, which is determined at that time point, may be acquired, and the determination of S303 may be performed.

Moreover, in the above description, the another-driver recognition state determination processing is performed based on whether the subject vehicle enters the viewable range of the target vehicle; however, the disclosure is not limited to this configuration. The another-driver recognition state determination processing may be performed using, as a starting point, transmission of a recognition information requesting signal for requiring, from the subject vehicle, the other vehicle to be a target of the another-driver recognition state determination processing to transmit the recognition information signal. Furthermore, in the above description, the recognition information transmission-related processing is performed based on whether the target vehicle enters the viewable range of the subject vehicle; however, the disclosure is not limited to this configuration. The subject-driver recognition state determination processing may be performed using, as a starting point, reception of the recognition information requesting signal for requiring transmission of the recognition information signal from the other vehicle, and the recognition information signal is transmitted back to the other vehicle.

Furthermore, the recognition information requesting signal described above may be automatically transmitted based on the positional relationship between the other vehicle and the subject vehicle or may be transmitted when the driver of the subject vehicle operates the input device 8.

Each of the flowcharts or the processes in the flowcharts shown in the present application may include multiple steps (or referred to also as sections). Each of the steps is represented as, for example, S101. Each of the steps may further be divided into sub-steps. Furthermore, several steps may be combined to form one step.

While the embodiments and constructions according to the present disclosure have been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A vehicle recognition notification apparatus mounted on a subject vehicle comprising:

a recognition information reception processing section that receives a recognition information signal transmitted from another vehicle and indicating that a driver of the other vehicle recognizes the subject vehicle;

an another-driver recognition state determination section that determines whether the driver of the other vehicle recognizes the subject vehicle based on the recognition information signal received by the recognition information reception processing section;

an informing control section that informs a driver of the subject vehicle of a result of a determination made by the another-driver recognition state determination section based on the recognition information signal;

a subject-driver recognition state determination section that determines whether the driver of the subject vehicle recognizes a predetermined other vehicle;

a recognition information transmission processing section that transmits to the other vehicle a recognition information signal indicating whether the driver of the subject vehicle recognizes the other vehicle, based on a result of a determination made by the subject-driver recognition state determination section;

a subject-vehicle position acquisition section that acquires a position of the subject vehicle;

a vehicle information reception processing section that receives vehicle information transmitted by the other vehicle and including information to specify a position of the other vehicle;

an another-vehicle position acquisition section that acquires the position of the other vehicle based on the vehicle information received by the vehicle information reception processing section; and a visual line detection section that detects a visual line direction of the driver of the subject vehicle, wherein:

the subject-driver recognition state determination section determines whether the driver of the subject vehicle recognizes the other vehicle, based on the visual line direction detected by the visual line detection section, the position of the subject vehicle acquired by the subject-vehicle position acquisition section, and the position of the other vehicle acquired by the another-vehicle position acquisition section;

the another-driver recognition state determination section determines whether the subject vehicle is present in a predetermined viewable range of the other vehicle, based on the position of the subject vehicle acquired by the subject-vehicle position acquisition section and the position of the other vehicle acquired by the another-vehicle position acquisition section;

the another-driver recognition state determination section determines that a recognition state indicating whether the driver of the other vehicle recognizes the subject vehicle is unclear when not receiving the recognition information signal from the other vehicle within a particular period of time after the determination that the subject vehicle is present in the viewable range of the other vehicle;

the another-driver recognition state determination section determines that the driver of the other vehicle recognizes the subject vehicle when receiving from the other vehicle the recognition information signal indicating that the driver of the other vehicle recognizes the subject vehicle within a particular period of time after the determination that the subject vehicle is present in the viewable range of the other vehicle; and the another-driver recognition state determination section determines that the driver of the other vehicle does not recognize the subject vehicle when receiving from the other vehicle the recognition information signal indicating that the driver of the other vehicle does not recognize the subject vehicle within a particular period of time after the determination that the subject vehicle is present in the viewable range of the other vehicle.

2. The vehicle recognition notification apparatus according to claim 1, wherein:

the subject-driver recognition state determination section determines whether the other vehicle is present in a predetermined viewable range of the subject vehicle, based on the position of the subject vehicle acquired by the subject-vehicle position acquisition section and the position of the other vehicle acquired by the another-vehicle position acquisition section; and the subject-driver recognition state determination section determines whether the driver of the subject vehicle recognizes the other vehicle when determining that the subject vehicle is present in a viewable range of the other vehicle.

3. The vehicle recognition notification apparatus according to claim 1, further comprising:

a target-vehicle setting section that sets, as a target vehicle, the other vehicle to be a target for determination made by the subject-driver recognition state determination section among a plurality of other vehicles present on a periphery of the subject vehicle, wherein:

the subject-driver recognition state determination section determines whether the driver of the subject vehicle recognizes the other vehicle when the other vehicle set as the target vehicle by the target-vehicle setting section is present in the viewable range of the subject vehicle; and the target-vehicle setting section sets as the target vehicle the other vehicle, a traveling direction of which and a traveling direction of the subject vehicle forms an angle within a particular angle and which is present within a predetermined target-vehicle setting distance, among the plurality of the other vehicles.

4. The vehicle recognition notification apparatus according to claim 1, further comprising:

a positional relationship change detection section that specifies a positional relationship between the subject vehicle and the other vehicle, based on a relative position of the other vehicle with respect to the subject vehicle, the relative position being defined from the position of the subject vehicle and the position of the other vehicle, and detects a behavior of the other vehicle attempting to change the positional relationship between the subject vehicle and the other vehicle, wherein:

the recognition information transmission processing section transmits the recognition information signal to the other vehicle, based on that the positional relationship change detection section detects the behavior of the other vehicle attempting to change the positional relationship between the subject vehicle and the other vehicle.

5. The vehicle recognition notification apparatus according to claim 4, wherein:

the positional relationship change detection section includes an overtaken determination section that determines whether the other vehicle attempts to overtake the subject vehicle; and the recognition information transmission processing section transmits the recognition information signal to the other vehicle based on that the overtaken determination section determines that the other vehicle attempts to overtake the subject vehicle.

6. The vehicle recognition notification apparatus according to claim 1, further comprising:

a positional relationship change detection section that specifies a positional relationship between the subject vehicle and the other vehicle based on a relative position of the other vehicle with respect to the subject vehicle, the relative position being defined from the position of the subject vehicle and the position of the other vehicle, and detects a behavior of the subject vehicle attempting to change the positional relationship between the subject vehicle and the other vehicle, wherein:

the another-driver recognition state determination section starts processing of determining whether the driver of the other vehicle recognizes the subject vehicle, based on that the positional relationship change detection section detects the behavior of the subject vehicle attempting to change the positional relationship between the subject vehicle and the other vehicle.

7. The vehicle recognition notification apparatus according to claim 6, wherein:

the positional relationship change detection section includes an overtaking determination section that determines whether the subject vehicle attempts to overtake the other vehicle; and the another-driver recognition state determination section starts processing of determining a recognition state indicating whether the driver of the other vehicle recognizes the subject vehicle when the overtaking determination section determines that the subject vehicle attempts to overtake the other vehicle.

8. A vehicle recognition notification system comprising:

a first vehicle recognition notification apparatus mounted on a first vehicle; and a second vehicle recognition notification apparatus mounted on a second vehicle, wherein:

the first vehicle recognition notification apparatus includes a subject-driver recognition state determination section that determines whether a driver of the first vehicle recognizes the second vehicle, a recognition information transmission processing section that transmits to the second vehicle recognition information a signal indicating that the driver of the first vehicle recognizes the second vehicle when the subject-driver recognition state determination section determines that the driver of the first vehicle recognizes the second vehicle, a first-vehicle position acquisition section that acquires a position of the first vehicle, a first-vehicle vehicle information reception processing section that receives vehicle information transmitted by the second vehicle and including information to specify a position of the second vehicle, a first-vehicle another-vehicle position acquisition section that acquires the position of the second vehicle based on the vehicle information received by the first-vehicle vehicle information reception processing section, and a visual line detection section that detects a visual line direction of the driver of the first vehicle;

the subject-driver recognition state determination section determines whether the driver of the first vehicle recognizes the second vehicle, based on the visual line direction detected by the visual line detection section, the position of the first vehicle acquired by the first-vehicle subject-vehicle position acquisition section, and the position of the second vehicle acquired by the first-vehicle-side another-vehicle position acquisition section;

the second vehicle recognition notification apparatus includes a recognition information reception processing section that receives the recognition information signal transmitted from the first vehicle, an another-driver recognition state determination section that determines whether the driver of the first vehicle recognizes the second vehicle based on the recognition information signal received by the recognition information reception processing section, an informing control section that informs a driver of the second vehicle of a result of a determination made by the another-driver recognition state determination section based on the recognition information signal, a second-vehicle subject-vehicle position acquisition section that acquires a position of the second vehicle, a second-vehicle vehicle information reception processing section that receives vehicle information transmitted by the first vehicle and including information to specify a position of the first vehicle, and a second-vehicle another-vehicle position acquisition section that acquires the position of the first vehicle based on the vehicle information received by the second-vehicle vehicle information reception processing section;

the another-driver recognition state determination section determines whether the second vehicle is present in a predetermined viewable range of the first vehicle, based on the position of the second vehicle acquired by the second-vehicle subject-vehicle position acquisition section and the position of the first vehicle acquired by the second-vehicle another-vehicle position acquisition section;

the another-driver recognition state determination section determines that a recognition state indicating whether the driver of the first vehicle recognizes the second vehicle is unclear when not receiving the recognition information signal from the first vehicle within a particular period of time after the determination that the second vehicle is present in the viewable range of the first vehicle;

the another-driver recognition state determination section determines that the driver of the first vehicle recognizes the second vehicle when receiving from the first vehicle the recognition information signal indicating that the driver of the first vehicle recognizes the second vehicle within a particular period of time after the determination that the second vehicle is present in the viewable range of the first vehicle; and the another-driver recognition state determination section determines that the driver of the first vehicle does not recognize the second vehicle when receiving from the first vehicle the recognition information signal indicating that the driver of the first vehicle does not recognize the second vehicle within a particular period of time after the determination that the second vehicle is present in the viewable range of the first vehicle.

* * * * *